US010719043B2

(12) United States Patent
Horie et al.

(10) Patent No.: US 10,719,043 B2
(45) Date of Patent: Jul. 21, 2020

(54) FIXING DEVICE AND IMAGE FORMING APPARATUS

(71) Applicant: HEWLETT-PACKARD DEVELOPMENT COMPANY, L.P., Spring, TX (US)

(72) Inventors: Takayuki Horie, Yokohama (JP); Tatsunori Izawa, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/453,472

(22) Filed: Jun. 26, 2019

(65) Prior Publication Data

US 2019/0317437 A1 Oct. 17, 2019

Related U.S. Application Data

(63) Continuation of application No. PCT/KR2017/006286, filed on Jun. 16, 2017.

(30) Foreign Application Priority Data

Dec. 27, 2016 (JP) ..... 2016-253513

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01)

(58) Field of Classification Search
None
See application file for complete search history.

(56) References Cited

U.S. PATENT DOCUMENTS

2010/0303525 A1* 12/2010 Mitsuoka ..... G03G 15/2039 399/329
2017/0199489 A1* 7/2017 Shimomura ..... G03G 15/2053

FOREIGN PATENT DOCUMENTS

| | | | |
|---|---|---|---|
| JP | 2001-267050 A | | 9/2001 |
| JP | 2002139956 A | * | 5/2002 |
| JP | 2005-275408 A | | 10/2005 |
| JP | 2006-084996 A | | 3/2006 |
| JP | 2007-279266 A | | 10/2007 |
| JP | 2008-268758 A | | 11/2008 |

OTHER PUBLICATIONS

JP _2002139956_A_T Translation, Japan, Fujita (Year: 2002).*

* cited by examiner

*Primary Examiner* — Victor Verbitsky
(74) *Attorney, Agent, or Firm* — Staas & Halsey LLP

(57) ABSTRACT

A fixing device includes a rotatable endless fixing belt, a heat source, a heat radiation plate, and a power supply. The fixing belt is operable between a non-expanded state and a thermally expanded state. The heat source is disposed adjacent the fixing belt, to heat the fixing belt. The heat radiation plate is adjacent the fixing belt to contact the fixing belt when the fixing belt is in the thermally expanded state as a result of being heated by the heat source. The power supply shutoff member adjacent the fixing belt to shut off the supply of power to the heat source based on a state of the fixing belt.

20 Claims, 45 Drawing Sheets

FIXING DEVICE AND IMAGE FORMING APPARATUS

CROSS-REFERENCE TO RELATED APPLICATIONS

This application is a continuation application of PCT International Patent Application No. PCT/KR2017/006286, filed Jun. 16, 2017, which claims priority from Japanese Patent Application No. 2016-253513, filed on Dec. 27, 2016, the disclosures of each of the foregoing is incorporated herein by reference.

BACKGROUND

Some image forming apparatuses are provided with a fixing device that fixes onto a recording medium a toner image carried on the recording medium by heating and applying pressure on the recording medium. The fixing device pushes a pusher member disposed on an inner peripheral side of a fixing belt toward a pressure roller disposed on an outer peripheral side of the fixing belt to form a fixing nip between the fixing belt and the pressure roller. Then, the fixing device heats the fixing belt via a heat source such as a halogen lamp disposed on an inner peripheral side of the fixing belt to heat a recording medium passing through the fixing nip.

DETAILED DESCRIPTION

Figure 1:
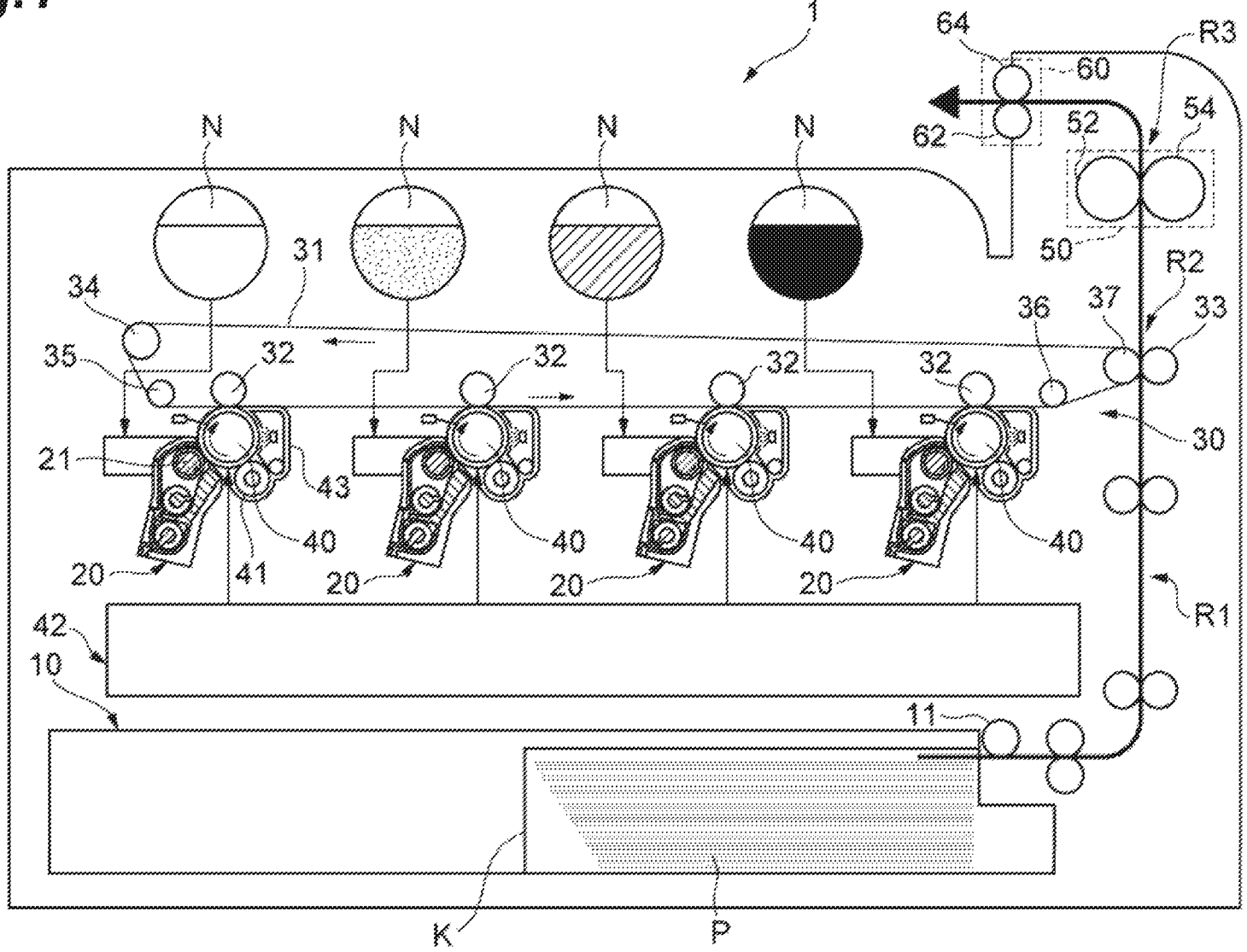
FIG. 1 is a schematic diagram of an example image forming apparatus.
Figure 2:
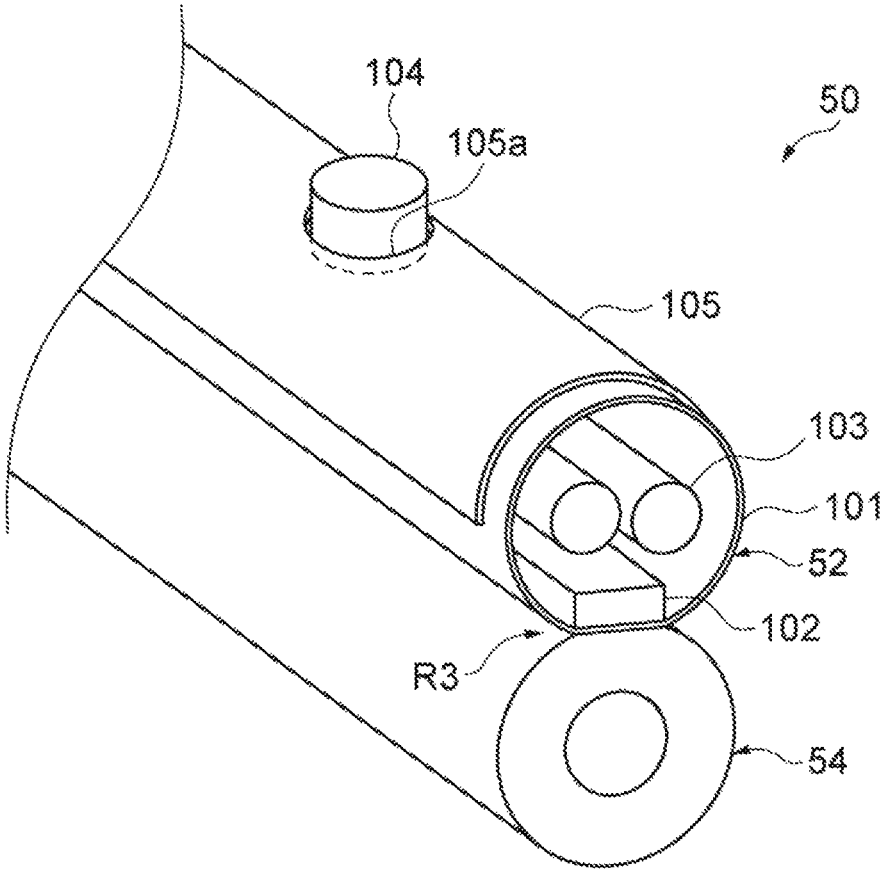
FIG. 2 is a schematic perspective view of an example fixing device.
Figure 3:
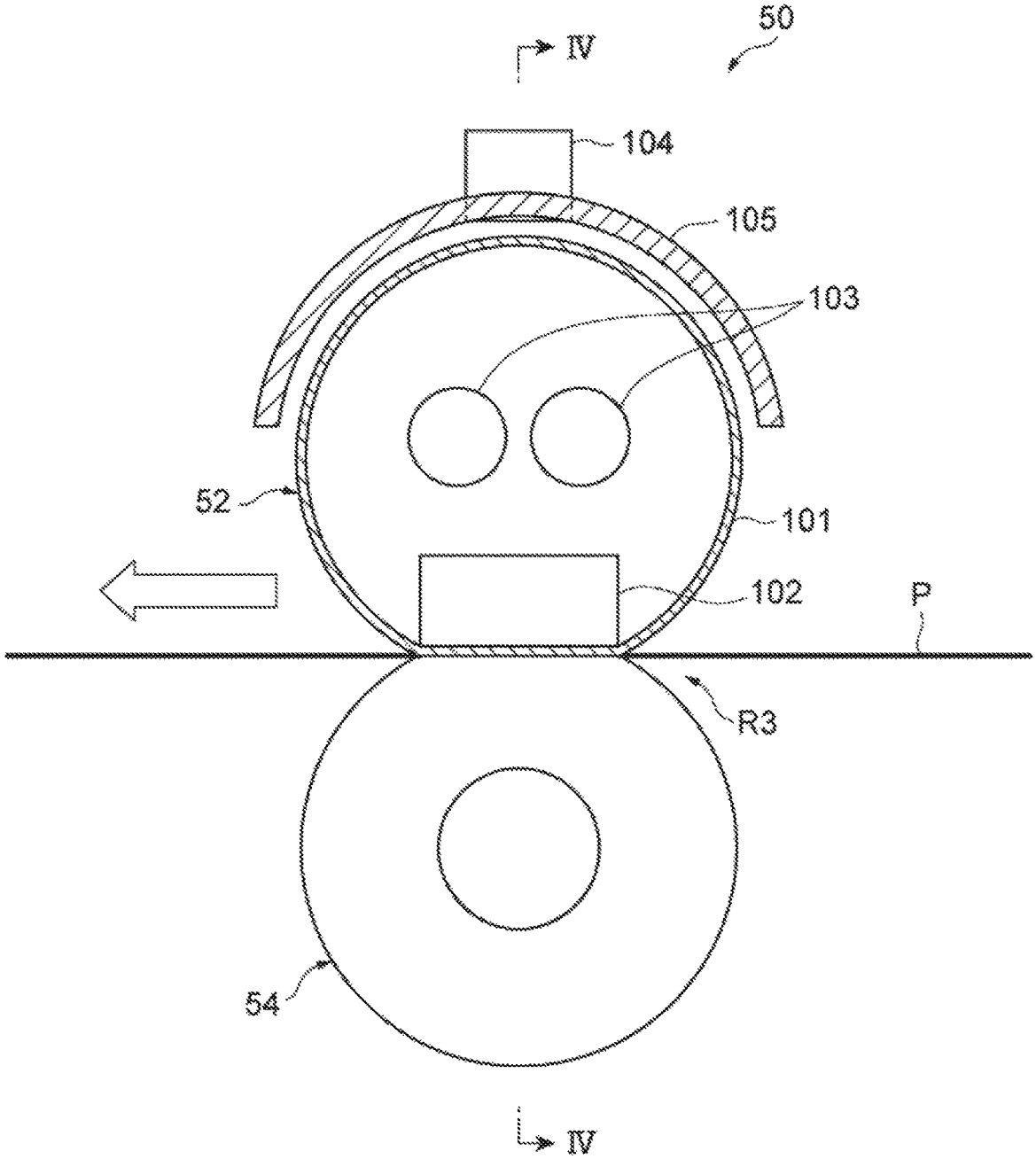
FIG. 3 is a schematic cross-sectional view of the fixing device illustrated in FIG. 2.
Figure 4:
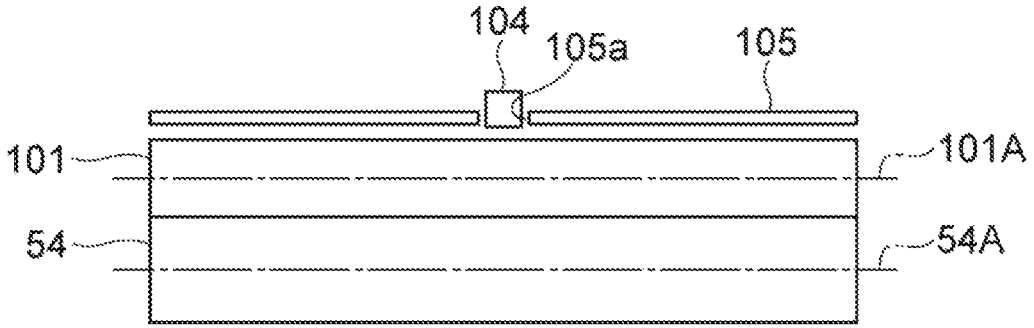
FIG. 4 is a schematic cross-sectional view of the fixing device illustrated in FIG. 3, taken along line IV-IV.
Figure 5:
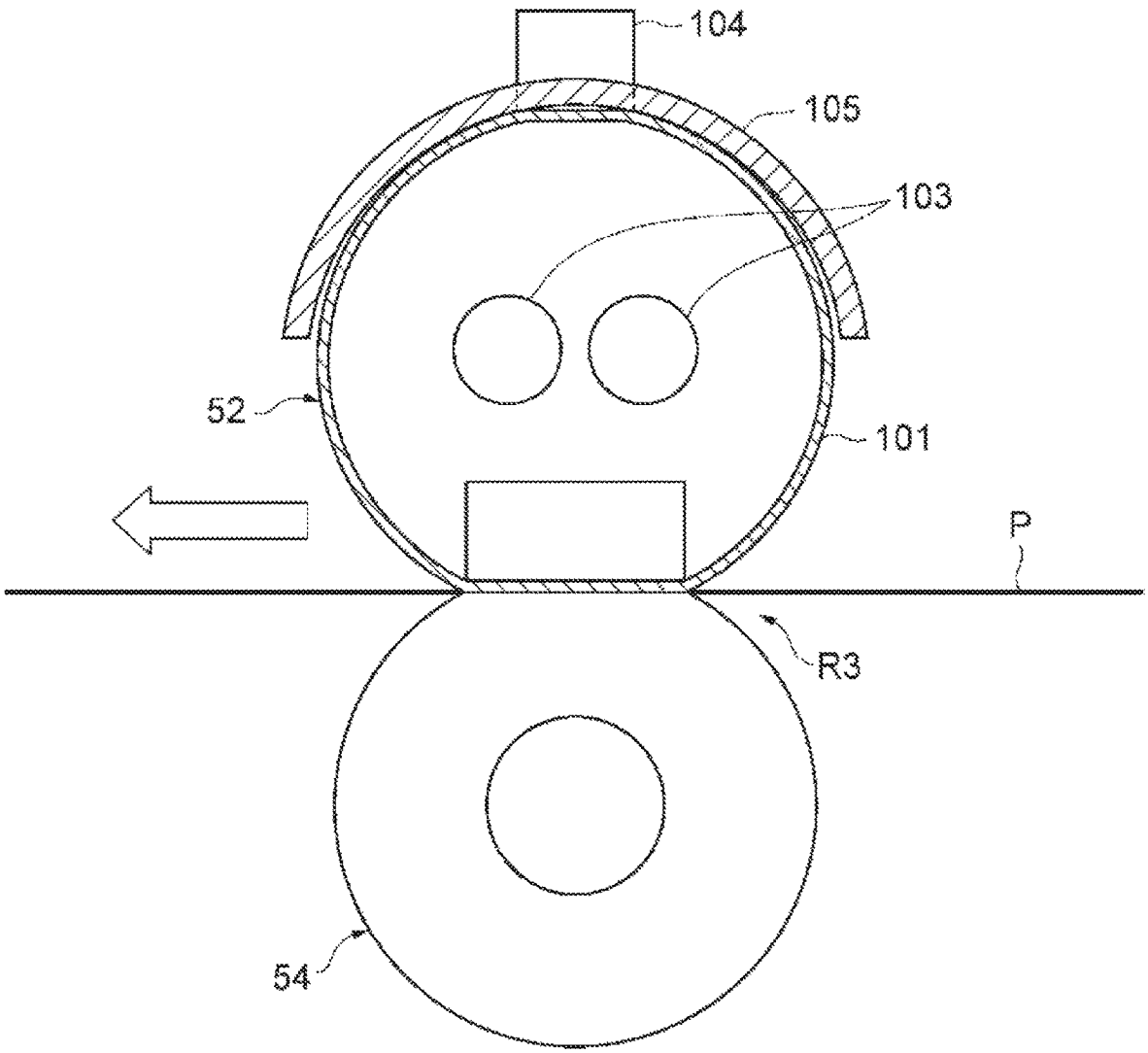
FIG. 5 is a schematic lateral side view of an example fixing device having a fixing belt in a thermally expanded state.

In the following description, with reference to the drawings, the same reference numbers are assigned to the same components or to similar components having the same function, and overlapping description is omitted.

In some image forming apparatuses, the fixing device is provided with a power supply shutoff member on an outer peripheral side of the fixing belt to prevent ignition caused by unusual heating of the fixing belt. The power supply shutoff member stops supplying power to the heat source when the temperature of the fixing belt exceeds a threshold value.

When the temperature of the fixing belt increases due to unusual heating from the heat source, the fixing belt expands in the initial stage and thereafter contracts (buckles). The fixing belt contracts as the fixing belt cannot withstand the expansion or partially melts and yieldingly deforms radially and inwardly. Such contraction is also called buckling. When the fixing belt contracts, the fixing belt is separated from the power supply shutoff member and the stopping of the power supply to the heat source is delayed.

In some fixing devices that are provided with detection means for detecting inward deformation of the fixing belt to detect unusual heating of the fixing belt, the fixing belt may contract which may cause smoke or ignition (e.g. causing a fire).

An example fixing device to fix a toner image onto a recording medium, may comprise a rotatable endless fixing belt, a pusher member, a pressure roller, a heat source, a power supply shutoff member, and a heat radiation plate. The pusher member is disposed on an inner peripheral side of the fixing belt and extends in a direction parallel with a rotation axis of the fixing belt. The pressure roller is disposed on an outer peripheral side of the fixing belt and extends in a direction parallel with the rotation axis to form a fixing nip part by holding the fixing belt with the pusher member. The heat source is disposed on an inner peripheral side of the fixing belt and extends in a direction parallel with the rotation axis to heat the fixing belt. The power supply shutoff member is disposed on an outer peripheral side of the fixing belt to shut off the supply of power to the heat source depending on a state of the fixing belt. The heat radiation plate is disposed on an outer peripheral side of the fixing belt to cover part of the fixing belt. The heat radiation plate is disposed in a position which is separated from the fixing belt before thermal expansion and at which it comes in contact with the fixing belt upon thermal expansion.

In this example fixing device, the heat radiation plate to cover part of the fixing belt is disposed on an outer peripheral side of the fixing belt in a position which is separated from the fixing belt before thermal expansion and at which it comes in contact with the fixing belt upon thermal expansion. Accordingly, the fixing belt can rotate without being obstructed by the heat radiation plate before the fixing belt thermally expands. When the fixing belt thermally expands, the fixing belt may come in contact with the heat radiation plate to dissipate heat to the heat radiation plate. In this manner, the time (or duration) before the fixing belt contracts can be extended. This enables to shutoff the supply of power to the heat source by the power supply shutoff member before the fixing belt contracts.

In some image forming apparatuses, the power supply shutoff member does not operate immediately after contacting the fixing belt, but rather when a predetermined time has passed from the contact with the fixing belt.

In some example fixing devices, the time until the fixing belt contracts can be prolonged, and thus the time the thermally expanded fixing belt contacts the power supply shutoff member can be prolonged. Accordingly, even in comparative fixing devices where the fixing belt contracts before the operation of the power supply shutoff member, the contraction of the fixing belt before the operation of the power supply shutoff member can be suppressed.

In some example fixing devices, a minimum distance between the fixing belt before thermal expansion and the heat radiation plate may be 5 mm or less, and the thermally expanded fixing belt may be made to contact with the heat radiation plate before contraction.

In some example fixing devices, the heat radiation plate may have a curved profile that conforms with the thermally expanded fixing belt. Accordingly, the area of contact of the fixing belt with the heat radiation plate can be increased. This enables to increase the amount of heat conducted from the fixing belt to the heat radiation plate.

In some example fixing devices, the heat radiation plate may include a metal. Accordingly, the amount of heat conducted from the fixing belt to the heat radiation plate can be increased, as compared with a case where the heat radiation plate is made of a resin.

In some example fixing devices, the metal material of the heat radiation plate may be Al, Cu, SUS or an alloy containing at least one of the aforementioned Al, Cu and SUS, to increase the heat conductivity of the heat radiation plate.

In some example fixing devices, the heat radiation plate may include a heat resistant resin to improve the workability of the heat radiation plate.

In some example fixing devices, the resin material of the heat radiation plate may be PI, PAI, PTFE, PEEK, LCP, PPS or a composition including at least one of the aforementioned PI, PAI, PTFE, PEEK, LCP and PPS. Accordingly, the heat resistance of the heat radiation plate can be increased.

In some example fixing devices, heat radiation plate and the power supply shutoff member may be disposed substantially along the same line extending in the direction of the rotation axis of the fixing belt. For example, the heat radiation plate and the power supply shutoff member may be arranged linearly in the direction of the rotation axis of the fixing belt. Accordingly, the thermally expanded fixing belt can contact the power supply shutoff member while dissipating heat also along the line from the thermally expanded fixing belt to the heat radiation plate.

In some example fixing devices, the power supply shutoff member may be disposed in an opening formed in the heat radiation plate. Accordingly, the heat radiation plate can be prevented from being interposed between the power supply shutoff member and the fixing belt, in order to directly bring the thermally expanded fixing belt into contact with the power supply shutoff member.

In many fixing devices, the amount of deviation of the fixing belt caused by the expansion of the fixing belt, is the largest at a position of the fixing belt which is the farthest away from the fixing nip part.

In some example fixing devices, the power supply shutoff member is located in the vicinity of a position the fixing belt which is the farthest away from the fixing nip part, to improve the operation of the power supply shutoff member.

A position of the fixing belt at which the temperature caused by heating from the heat source is maximum may be defined as a maximum temperature position. In some example fixing devices, the power supply shutoff member is disposed in the vicinity of the maximum temperature position, to improve the operation of the power supply shutoff member.

A surface of the power supply shutoff member to contact with the thermally expanded fixing belt may be defined as a detection surface. In some example fixing devices, a minimum distance between the fixing belt before thermal expansion and the detection surface is shorter than a minimum distance between the fixing belt before thermal expansion and the heat radiation plate. Accordingly, the thermally expanded fixing belt makes contact with the detection surface prior to the heat radiation plate, to operate the power supply shutoff member earlier.

In some example fixing devices, a difference between the minimum distance between the fixing belt before thermal expansion and the detection surface and the minimum distance between the fixing belt before thermal expansion and the heat radiation plate may be 3 mm or less. Accordingly, if the thermally expanded fixing belt contacts the detection surface prior to the heat radiation plate, the fixing belt can still contact the heat radiation plate, to better suppress contraction of the fixing belt.

In some example fixing devices, a thermal capacity of the heat radiation plate per unit area may be larger than the thermal capacity of the fixing belt per unit area, to increase the heat transfer efficiency from the fixing belt to the heat radiation plate.

In some example fixing devices, in the peripheral direction of the fixing belt, an area of the fixing belt covered by the heat radiation plate may be 10% or more and 70% or less of the peripheral length of the fixing belt. When the area of the fixing belt covered by the heat radiation plate is 10% or more of the peripheral length of the fixing belt, heat dissipation from the fixing belt to the heat radiation plate can be improved. When the area of the fixing belt covered by the heat radiation plate is 70% or less of the peripheral length of the fixing belt, the heat radiation plate can be made smaller in size.

Some example fixing devices may include a plurality of the heat radiation plate in the peripheral direction of the fixing belt. The heat radiation plates can be disposed in accordance with the arrangement or the like of peripheral devices around the fixing belt. Accordingly, the degree of freedom of disposing the heat radiation plate may be increased.

In some example fixing devices, a surface of the heat radiation plate facing the fixing belt may be provided with an adhesive, and the thermally expanded fixing belt can abut to the heat radiation plate and bond to the heat radiation plate. Accordingly, the adhesion between the heat radiation plate and the fixing belt can be increased, and the heat conductivity from the fixing belt to the heat radiation plate can be increased.

In some example fixing devices, the heat source may be a halogen lamp. Accordingly, the fixing belt can be heated easily and the heating can be controlled easily.

In some example fixing devices, a surface of the heat radiation plate facing the fixing belt may be a reflection surface that reflects radiant heat from the fixing belt back to the fixing belt, to improve the heating efficiency of the fixing belt during a normal operation in which the fixing belt is not thermally expanded.

In some example fixing devices, the reflection surface may be a mirror surface. Accordingly, radiant heat from the fixing belt can be reflected to the fixing belt efficiently.

In some example fixing devices, the power supply shutoff member may be a thermostat that includes a bimetal and shuts off the supply of power to the heat source when the temperature of the bimetal exceeds a threshold value. The fixing belt contracts depending on the temperature of the fixing belt. Accordingly, the thermostat may operate as the power supply shutoff member to better control the contraction of the fixing belt.

In some example fixing devices, the power supply shutoff member may be a pressure-sensitive circuit breaker which, when pushed by the thermally expanded fixing belt, shuts off the supply of power to the heat source. The contraction of the fixing belt depends not only on the temperature of the fixing belt, but also the amount of expansion of the fixing belt. Accordingly, the pressure-sensitive circuit breaker may operate as the power supply shutoff member to better control the contraction of the fixing belt.

In some example fixing devices, the fixing belt may have a layered structure including two or more layers, and a base layer. For example, the innermost layer of the fixing belt, may be composed of a resin. The base layer of the fixing belt may be made of a resin, to increase a nip-shape following property of the fixing belt.

In some example fixing belts, the resin material of the base layer may be PI, PEEK, PAI or a composition comprising at least one of these, to improve the heat resistance of the fixing belt.

The thickness of the base layer may be 150 μm or less, to suppress the heat conductivity from decreasing, while suppressing decrease in the nip-shape following property of the fixing belt.

The heat conductivity of the base layer may be 2.0 W/mK or less, to suppress the durability property of the base layer from decreasing.

Some example fixing belts may have a layered structure including two or more layers, and a base layer. For example, the innermost layer of the fixing belt, may be made of a metal, to increase the durability and stiffness of the fixing belt.

The metal material of the base layer may be SUS, Cu, Ni or an alloy containing at least one of these, to increase the heat conductivity of the base layer.

The thickness of the base layer may be 70 μm or less, to suppress the heat conductivity from decreasing, while suppressing decrease in the nip-shape following property of the fixing belt.

The thermal expansion coefficient of the base layer may be $1.0\times10^{-5}$ m/K or more and $100\times10^{-5}$ m/K or less. When the thermal expansion coefficient of the base layer is $1.0\times10^{-5}$ m/K or more, the nip-shape following property of the fixing belt can be increased or improved. When the thermal expansion coefficient of the base layer is $100\times10^{-5}$ m/K or less, the fixing belt can be inhibited from expanding or contracting prematurely.

Some example fixing devices may further comprise an elastic member that pushes the power supply shutoff member by an elastic force toward the fixing belt. The heat radiation plate may have a first heat radiation plate and a second heat radiation plate which are divided in the peripheral direction of the fixing belt and disposed to contact with or separate from each other. The power supply shutoff member may be latched from the side of the fixing belt by at least one of the first heat radiation plate and the second heat radiation plate such that, when the fixing belt thermally expands to push open at least one of the first heat radiation plate and the second heat radiation plate, the power supply shutoff member can be pressed against the fixing belt by the elastic force of the elastic member. Since the first heat radiation plate and the second heat radiation plate are divided in the peripheral direction of the fixing belt and disposed to contact with or separate from each other, when the fixing belt thermally expands to push the first heat radiation plate and the second heat radiation plate, the first heat radiation plate and the second heat radiation plate are made to open in the peripheral direction of the fixing belt. For example, when the fixing belt thermally expands, the first heat radiation plate and the second heat radiation plate move away from each other. Then, the latching by the first heat radiation plate and the second heat radiation plate is released and the power supply shutoff member is pushed against the fixing belt by the elastic member. With this, the power supply shutoff member can more reliably contact the fixing belt and the contact state can be maintained to better operate the power supply shutoff member.

The elastic member may be a spring, to better urge the power supply shutoff member against the fixing belt. When the elongation amount of the spring is adjusted, the power supply shutoff member can be suppressed from being excessively urged or pressed against the fixing belt.

The distance between the first heat radiation plate and the second heat radiation plate may be 0 mm or more and 3 mm or less. Accordingly, the power supply shutoff member can be more reliably latched by the first heat radiation plate and the second heat radiation plate before the fixing belt thermally expands and, when the fixing belt has thermally expanded, the power supply shutoff member can be more reliably urged or pressed against the fixing belt through the spacing between the first heat radiation plate and the second heat radiation plate.

In the peripheral direction of the fixing belt, a latch width for latching the power supply shutoff member by the heat radiation plate may be 0.1 mm or more and 1 mm or less. When the latch width for latching the power supply shutoff member by the heat radiation plate is 0.1 mm or more, the power supply shutoff member can be more reliably latched by the first heat radiation plate and the second heat radiation plate. When the latch width is 1 mm or less, the latching of the power supply shutoff member by the first heat radiation plate and the second heat radiation plate can be released and the power supply shutoff member can be urged or pressed against the fixing belt as soon as the fixing belt has thermally expanded to push open the first heat radiation plate and the second heat radiation plate.

The latching surface of the heat radiation plate to latch the power supply shutoff member may have a static friction coefficient of 0.1 or more and 1.0 or less, relative to the power supply shutoff member. When the static friction coefficient of the latching surface relative to the power supply shutoff member is 0.1 or more, the manufacturability of the heat radiation plate can be increased. When the static friction coefficient of the latching surface relative to the power supply shutoff member is 1.0 or less, the latching of the power supply shutoff member by the first heat radiation plate and the second heat radiation plate can be released and the power supply shutoff member can be pressed against the fixing belt as soon as the fixing belt thermally has expanded to push open the first heat radiation plate and the second heat radiation plate.

The latching surface of the heat radiation plate to latch the power supply shutoff member may be provided with a fluororesin coating Accordingly, the static friction coefficient of the latching surface can be decreased.

In some example fixing devices, power supply shutoff member may be latched from the side of the fixing belt by both of the first heat radiation plate and the second heat radiation plate, the first heat radiation plate may be swingably pivoted through a first pivot part at the other end opposite from the power supply shutoff member, and the second heat radiation plate may be swingably pivoted through a second pivot part at the other end opposite from the power supply shutoff member. Accordingly, the latching of the power supply shutoff member can be released more easily when the fixing belt has thermally expanded to push open the first heat radiation plate and the second heat radiation plate.

The first heat radiation plate and the second heat radiation plate may be coupled through a linkage mechanism that associates the swing movements with each other. Accordingly, the first heat radiation plate and the second heat radiation plate can both be opened at the same time when the fixing belt has thermally expanded, and the latching of the power supply shutoff member can be prevented from releasing when only one of the first heat radiation plate and the second heat radiation plate has opened.

A line that is parallel with a push direction in which the elastic member pushes the power supply shutoff member and extends through a first latch position at which the first heat radiation plate latches the power supply shutoff member may be defined as a first reference line and a line that is parallel with the push direction and extends through a second latch position at which the second heat radiation plate latches the power supply shutoff member may be defined as a second reference line. In some example fixing devices, the first pivot part may be situated outward of the first reference line and the second pivot part may be situated outward of the second reference line. The first latch position and the second latch position may be situated inward of the first pivot part and the second pivot part in the direction along which the first heat radiation plate and the second heat radiation plate are made to open and close. Accordingly, the elastic force acting in the direction of pushing by the elastic member is converted to a directional force to close the first heat radiation plate and the second heat radiation plate. This enables to suppress the first heat radiation plate and the second heat radiation plate from opening (e.g. moving away from each other) before the fixing belt has thermally expanded.

In some examples, one of the first heat radiation plate and the power supply shutoff member may be provided with a first projection that projects toward the other of the first heat radiation plate and the power supply shutoff member, the other of the first heat radiation plate and the power supply shutoff member may be provided with a first recess into which the first projection is inserted, one of the second heat radiation plate and the power supply shutoff member may be provided with a second projection that projects toward the other of the second heat radiation plate and the power supply shutoff member, and the other of the second heat radiation plate and the power supply shutoff member may be provided with a second recess into which the second projection is inserted. When the first projection and the second projection are inserted into the first recess and the second recess, the first heat radiation plate and the second heat radiation plate can be suppressed from opening easily relative to the power supply shutoff member. Accordingly, the first heat radiation plate and the second heat radiation plate are inhibited from opening before the fixing belt has thermally expanded.

In some example fixing devices, the power supply shutoff member may not be latched by the second heat radiation plate from the side of the fixing belt, the first heat radiation plate may be swingably pivoted through the first pivot part at the other end opposite from the power supply shutoff member, and the second heat radiation plate may be unswingably fixed. When the second heat radiation plate is unswingably fixed and the power supply shutoff member is latched only by the first heat radiation plate, the first heat radiation plate is pushed open to unfailingly release the latching of the power supply shutoff member when the fixing belt thermally expands. Accordingly, the power supply shutoff member is more reliably pressed or urged against the fixing belt when the fixing belt has thermally expanded.

A line that is parallel with a push direction in which the elastic member pushes the power supply shutoff member and extends through a first latch position at which the first heat radiation plate latches the power supply shutoff member may be defined as a first reference line. In some example fixing devices, the first pivot part is situated outward of the first reference line, and the first latch position is situated inward of the first pivot part in the direction along which the first heat radiation plate is made to open and close. Accordingly, the elastic force acting in the direction of pushing by the elastic member is converted to a directional force to close the first heat radiation plate, thereby suppressing the first heat radiation plate from opening before the fixing belt has thermally expanded.

In some example fixing devices, a position of the fixing belt at which the temperature caused by heating from the heat source is maximum is defined as a maximum temperature position, and the first heat radiation plate may cover the maximum temperature position. The maximum temperature position of the fixing belt is a position at which thermal expansion and contraction most likely take place. Accordingly, when the first heat radiation plate covers the maximum temperature position, the first heat radiation plate can follow the thermal expansion of the fixing belt earlier and the power supply shutoff member can be pressed against the fixing belt earlier.

In some example fixing devices, one of the first heat radiation plate and the power supply shutoff member may be provided with a first projection that projects toward the other of the first heat radiation plate and the power supply shutoff member, and the other of the first heat radiation plate and the power supply shutoff member may be provided with a first recess into which the first projection is inserted. When the first projection is inserted into the first recess, the first heat radiation plate can be suppressed from opening easily relative to the power supply shutoff member, thereby inhibiting the first heat radiation plate from opening before the fixing belt has thermally expanded.

In some example fixing devices, a position of the fixing belt at which the temperature caused by heating from the heat source is maximum may be defined as a maximum temperature position, and a detection area in which the temperature of the fixing belt is detected may include the maximum temperature position. A surface of the power supply shutoff member to make contact with the thermally expanded fixing belt may be defined as a detection surface, and the detection area may include a region within 5 mm from the detection surface on the side of the fixing belt and within ±10 mm from the center of the detection surface in the peripheral direction of the fixing belt. The example fixing device may further include at least one deformation suppression member disposed on an inner peripheral side of the fixing belt and the deformation suppression member may be disposed in a position at which it does not come in contact with the fixing belt during rotation of the fixing belt but, upon contraction of the fixing belt, supports the fixing belt from an inner peripheral side of the fixing belt to maintain the maximum temperature position in the detection area. When the at least one deformation suppression members is disposed on an inner peripheral side of the fixing belt, the deformation suppression member is disposed in a position at which it does not come in contact with the fixing belt during rotation of the fixing belt so as to suppress obstruction to the rotation of the fixing belt. When the deformation suppression member is disposed in a position at which, upon contraction of the fixing belt, it supports the fixing belt from an inner peripheral side of the fixing belt to maintain the maximum temperature position in the detection area, the maximum temperature position of the fixing belt can be kept in the detection area even if the fixing belt has contracted. Accordingly, the power supply shutoff member can shutoff the supply of power to the heat source before the fixing belt smokes or ignites even when the fixing belt has contracted.

In some example fixing devices, the deformation suppression member may be disposed in a position at which it does not obstruct heating of the fixing belt from the heat source and the maximum temperature position is not placed outside the detection area.

The deformation suppression member may be disposed in the detection area, to more reliably maintain the maximum temperature position of the fixing belt in the detection area when the fixing belt has contracted.

The deformation suppression member may be disposed in a position at which it comes in contact with the fixing belt when the fixing belt is in a stationary state. Unusual heating of the fixing belt frequently occurs in a stationary state where the fixing belt is not rotating. Accordingly, when the deformation suppression member is made to come in contact with the fixing belt in a stationary state of the fixing belt, contraction associated with unusual heating of the fixing belt can be better suppressed and, even if the contraction has occurred, the maximum temperature position of the fixing belt can be maintained in the detection area.

The heat conductivity of the deformation suppression member may be 5 W/mK or more, to more effectively dissipate heat of the fixing belt to the deformation suppression member when the fixing belt comes in contact with the deformation suppression member.

The deformation suppression member may be formed in a rod shape. When the heat source is a halogen lamp, part of the radiant heat from the heat source may be blocked by the deformation suppression member. Accordingly, when the deformation suppression member is formed in a rod shape, the blocking of the radiant heat from the heat source by the deformation suppression member can be suppressed when a halogen lamp is used as the heat source.

The deformation suppression member may be juxtaposed with the heat source by extending on an inner peripheral side of the fixing belt in a direction parallel with the rotation axis, in order to inhibit the contraction of the fixing belt.

The cross-sectional area of the deformation suppression member in a direction orthogonal to the rotation axis of the fixing belt may be 1.0 $mm^2$ or more, to maintain the rigidity of the deformation suppression member formed in a rod shape.

The cross-sectional area of the deformation suppression member in a direction orthogonal to the rotation axis of the fixing belt may be 20 $mm^2$ or less, to suppress the blocking of the radiant heat from the heat source by the deformation suppression member when a halogen lamp is used as the heat source.

In the direction of the rotation axis of the fixing belt, a central part of the deformation suppression member may be curved to protrude relative to the ends. During rotation, in the direction of the rotation axis of the fixing belt, the central part of the fixing belt may be curved to protrude relative to the edges. Accordingly, the central part of the deformation suppression member is curved to protrude relative to the ends in the direction of the rotation axis of the fixing belt, so that the deformation suppression member can conform with the fixing belt.

In the direction of the rotation axis of the fixing belt, a central part of the deformation suppression member may be curved to recess relative to the ends. During rotation, in the direction of the rotation of the fixing belt, the central part of the fixing belt may be curved to recess in the central part relative to the edges. Accordingly, the central part of the deformation suppression member is curved to recess relative to the ends in the direction of the rotation axis of the fixing belt, so that the deformation suppression member can conform with the fixing belt.

The deformation suppression member may be made of a shape memory alloy Accordingly, the shape of the deformation suppression member can be changed to the aforementioned shapes depending on the temperature of the fixing belt.

The deformation suppression member may have an end attached to a holder member that holds an edge of the fixing belt, attached to a holder member that holds an end of the heat source, attached to a holder member that holds an end of the pressure roller, or attached to the pusher member.

An example image forming apparatus may be include any of the aforementioned fixing devices, in order to suppress a contraction of the fixing belt caused by unusual heating.

With reference to FIG. 1, an example image forming apparatus 1 is an apparatus to form color images using magenta, yellow, cyan and black colors. The example image forming apparatus 1 is provided with a conveyance unit 10 for conveying recording media such as paper sheets P, developing devices 20 for developing electrostatic latent images, a transfer unit 30 for secondarily transferring toner images to the paper sheets P, photosensitive drums 40 that are electrostatic latent image carriers to be formed with images on circumferential surfaces thereof, a fixing unit 50 for fixing the toner images onto the paper sheets P, and a discharge unit 60 for discharging the paper sheets P.

The conveyance unit 10 may convey the paper sheet P, e.g., recording media on which images are to be formed, along a conveyance path R1. The paper sheets P are stacked and contained in a cassette K, picked up by a feed roller 11 and conveyed.

The conveyance unit 10 may convey the paper sheets P to a transfer nip part R2 through the conveyance path R1 in such a timing that toner images to be transferred to the paper sheets P arrive at the transfer nip part R2.

Four developing devices 20 are provided for the respective four colors. Each of the developing devices 20 is provided with a developer roller 21 for carrying toner to the photosensitive drum 40.

In the developing device 20, toner and carrier may be adjusted at a predetermined mixing ratio, and mixed and stirred to disperse the toner uniformly so as to prepare a developer imparted with an optimal amount of charge. The developer is carried by the developer roller 21.

As the developer roller 21 may rotate to carry the developer to a region facing the photosensitive drum 40, toner is moved out of the developer carried on the developer roller 21 and onto an electrostatic latent image formed on the circumferential surface of the photosensitive drum 40 to develop the electrostatic latent image.

The transfer unit 30 may carry the toner images formed with the developing devices 20 to the transfer nip part R2 where the toner images are secondarily transferred to the paper sheets P. The transfer unit 30 is provided with a transfer belt 31 onto which the toner images are primarily transferred from the photosensitive drums 40, support rollers 34, 35, 36 and 37 for supporting the transfer belt 31, primary transfer rollers 32 for holding the transfer belt 31 with the photosensitive drums 40, and a secondary transfer roller 33 for holding the transfer belt with the support roller 37.

The transfer belt 31 may include an endless belt circularly driven by the support rollers 34, 35, 36 and 37. The support rollers 34, 35, 36 and 37 are rollers rotatable about the respective central axes. The support roller 37 may be a drive roller rotationally driven about the central axis, and the support rollers 34, 35 and 36 are driven rollers that are rotated to follow the driving rotation of the support roller 37. The primary transfer rollers 32 are disposed to press against the photosensitive drums 40 from an inner peripheral side of the transfer belt 31. The secondary transfer roller 33 is disposed in parallel with the support roller 37 to capture the transfer belt 31 and to press against the support roller 37 from an outer peripheral side the transfer belt 31. The secondary transfer roller 33 thereby forms the transfer nip part R2 with the transfer belt 31.

Four photosensitive drums 40 are provided for the respective four colors. Each of the photosensitive drums 40 is provided along the direction of movement of the transfer belt 31. The developing device 20, a charge roller 41, an exposure unit 42 and a cleaning unit 43 are arranged around the circumference of the photosensitive drum 40.

The charge roller 41 may be provided as charging means for uniformly charging the surface of the photosensitive drum 40 to a predetermined potential. The charge roller 41 is moved to follow the rotation of the photosensitive drum 40. The exposure unit 42 exposes the surface of the photosensitive drum 40 charged by the charge roller 41 in accordance with an image to be formed on the paper sheet P. The potential of portions on the surface of the photosensitive drum 40 exposed by the exposure unit 42 is thereby changed to form an electrostatic latent image. The four developing devices 20 use the toner supplied from toner tanks N provided opposite to the respective developing devices 20 to develop the electrostatic latent images formed on the photosensitive drums 40 and create toner images. The toner tanks N may be respectively filled with magenta, yellow, cyan and black toners. The cleaning unit 43 collects the toner remaining on the photosensitive drum 40 after the toner image formed on the photosensitive drum 40 has been primarily transferred onto the transfer belt 31.

The fixing unit 50 may adhere and fixate onto paper sheets P, toner images that have been secondarily transferred from the transfer belt 31 by passing the paper sheets P through a heated and pressed fixing nip part R3. The fixation unit 50 may include a heater roller 52 for heating the paper sheets P and a pressure roller 54 that is pressed against the heater roller 52 for rotationally driving. The heater roller 52 and the pressure roller 54 are formed in cylindrical shapes, and the heater roller 52 is internally provided with a heat source such as a halogen lamp. A contact area, or the fixation nip part R3 is formed between the heater roller 52 and the pressure roller 54, and the toner images are fused and fixated onto the paper sheets P while the paper sheets P are passed through the fixation nip part R3.

The discharge unit 60 is provided with discharge rollers 62 and 64 for discharging the paper sheets P on which the toner images have been fixed by the fixing device 50 to the outside of the apparatus.

When an image signal of a recording image is input to the example image forming apparatus 1, the controller of the image forming apparatus 1 may rotate the paper feed roller 11 to pick up and convey a paper sheet P from the stack in the cassette K. Then, based on the received image signal the surfaces of the photosensitive drums 40 may be uniformly charged to a predetermined potential by the charge rollers 41 (charging operation). Electrostatic latent images may be formed by irradiating laser light onto the surfaces of the photosensitive drums 40 with the exposure units 42 (exposing operation).

In the example developing devices 20, the electrostatic latent images may be developed to form toner images (developing operation). The formed toner images are primarily transferred from the photosensitive drums 40 to the transfer belt 31 in the regions at which the photosensitive drums 40 and the transfer belt 31 are facing each other (transferring operation). The toner images formed on the four photosensitive drums 40 may be successively superimposed on the transfer belt 31 to form a single composite toner image. The composite toner image is secondarily transferred onto the paper sheet P conveyed by the conveyance unit 10 in the transfer nip part R2 at which the support roller 37 and the secondary transfer roller 33 are opposed.

The paper sheet P, with the secondarily transferred composite toner image, may be conveyed to the fixing unit 50. Then, the composite toner image is fused and fixated onto the paper sheet P by heating and pressing the paper sheet P between the heater roller 52 and the pressure roller 54 while the paper sheet P is made to pass through the fixing nip part R3 (fixing operation).

The paper sheet P may be discharged to the outside of the image forming apparatus 1 by the discharge rollers 62 and 64.

With reference to FIG. 2 to FIG. 5, the fixing device 50 may include a fixing belt 101, the heater roller 52 including a pusher member 102 and a heat source 103, the pressure roller 54, a power supply shutoff member 104, and a heat radiation plate 105.

The fixing belt 101 is a rotatable endless belt and forms an outer peripheral surface of the heater roller 52. As such, the fixing nip part R3 is formed between the fixing belt 101 and the pressure roller 54.

Figure 6:
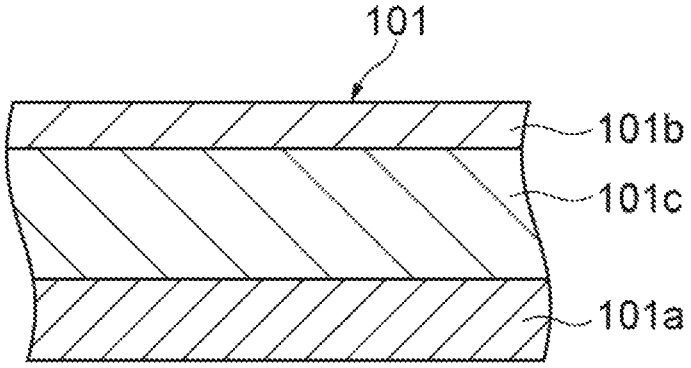
FIG. 6 is a schematic cross-sectional view of the example fixing device.

The fixing belt 101 may have a layered structure including two or more layers. The example fixing belt 101 has a layered structure including three layers. The example fixing belt 101 in FIG. 6 includes a base layer 101*a*, a surface layer 101*d*, and an intermediate layer 101*c*.

The base layer 101*a* is an innermost layer (layer situated on an inner peripheral side) of the fixing belt 101. The base layer 101*a* imparts stiffness to the fixing belt 101. The base layer 101*a* may be made of a resin or may be made of a metal.

When the base layer 101*a* is made of a resin, the resin material of the base layer 101*a* may include PI, PEEK, PA, or a composition comprising at least one of these, to improve high heat resistance.

The thickness of the base layer 101*a* made of a resin may be 150 μm or less in some example, or 100 μm or less in other examples, to suppress a decrease in heat conductivity and to suppress a decrease in a nip-shape following property of the fixing belt 101. The thickness of the base layer 101*a* made of a resin may be 30 μm or more in some examples, or 50 μm or more in other examples, to better suppress the shortening of life due to decrease in strength. The thickness of the base layer 101*a* made of a resin may be 30 μm or more and 150 μm or less in some examples, or 50 μm or more and 100 μm or less in other examples.

The heat conductivity of the base layer 101*a* made of a resin may be 2.0 W/mK or less in some examples, or 1.6 W/mK or less in other examples, to suppress the lowering of durability of the base layer 101*a*. The heat conductivity of the base layer 101*a* made of a resin may be 0.1 W/mK or more in some examples, or 0.2 W/mK or more in other examples, for an improved manufacturability of the base layer 101*a*. The heat conductivity of the base layer 101*a* made of a resin may be 0.1 W/mK or more and 2.0 W/mK or less in some examples, and 0.2 W/mK or more and 1.6 W/mK or less in other examples.

When the base layer 101*a* is made of a metal, the metal material of the base layer 101*a* may be SUS, Cu, Ni or an alloy containing at least one of these, for improved high heat conductivity.

The thickness of the base layer 101*a* made of a metal may be 70 μm or less in some examples, or 50 μm or less in other examples, to suppress a decrease in heat conductivity and to suppress a decrease in a nip-shape following property of the fixing belt 101. The thickness of the base layer 101*a* made of a metal is 5 μm or more in some examples, or 10 μm or more in other examples, to suppress a decrease in strength of the fixing belt 101 and thus extend its lifespan. The thickness of the base layer 101*a* made of a metal may be 5 μm or more and 70 μm or less in some examples, or 10 μm or more and 50 μm or less in other examples.

The heat conductivity of the base layer 101*a* made of a metal may be 600 W/mK or less in some examples, or 400 W/mK or less in other examples, to suppress the lowering of durability of the base layer 101*a*. The heat conductivity of the base layer 101*a* made of a metal may be 10 W/mK or more in some examples, or 15 W/mK or more in other examples, for an improved fixing property. The heat conductivity of the base layer 101*a* made of a metal may be 10 W/mK or more and 600 W/mK or less in some examples, or 15 W/mK or more and 400 W/mK or less in other examples.

The surface layer 101*b* may be an outermost layer (layer situated on an outer peripheral side) of the fixing belt 101.

The surface layer 101*b* may impart releasability from paper sheets P to the fixing belt 101. The surface layer 101*b* may be made of any material that provides a suitable releasability including, for example, a fluororesin such as PFA. The thickness of the surface layer 101*b* may be 5 μm or more and 100 μm or less in some examples, or 10 μm or more and 50 μm or less in other examples, for improved durability and fixing property.

The intermediate layer 101*c* may be located between the base layer 101*a* and the surface layer 101*b* of the fixing belt 101, to impart elasticity to the fixing belt 101. The intermediate layer may be made of any material that has a suitable elasticity including, for example, Si rubber. The thickness of the intermediate layer 101*c* may be 50 μm or more and 600 μm or less in some examples, or 100 μm or more and 500 μm or less in other examples, for an improved fixing property.

The pusher member 102 may form the pressed fixing nip part R3 between the fixing belt 101 and the pressure roller 54 by pressing the pressure roller 54 via the fixing belt 101. The pusher member 102 is disposed on an inner peripheral side of the fixing belt 101. The pusher member 102 extends in a direction parallel with a rotation axis 101A of the fixing belt 101. The ends of the pusher member 102 are elastically supported by a frame of the image forming apparatus 1 such that the pusher member 102 is pressed against the pressure roller 54 via the fixing belt 101.

The heat source 103 is disposed on an inner peripheral side of the fixing belt 101. The heat source 103 extends in a direction parallel with a rotation axis 101A of the fixing belt 101 to heat the fixing belt 101. Accordingly, when the heat source 103 heats the fixing belt 101, the fixing nip part R3 is heated. The heat source 103 may include a halogen lamp, in some examples. A reflector plate (not shown) that reflects light from the halogen lamp may be disposed between the halogen lamp and the pusher member 102 for efficiently irradiating light from the halogen lamp to the fixing belt 101. The heat source 103 may include one, two or more halogen lamp(s).

Figure 7:
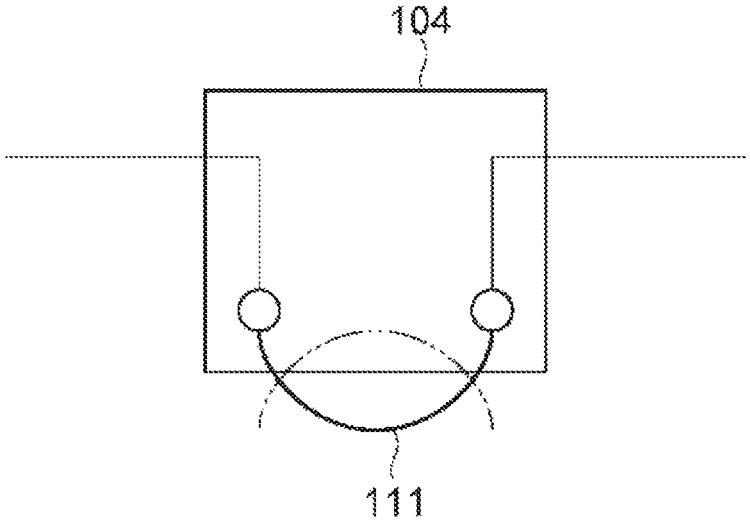
FIG. 7 is a schematic view of a thermostat, as a power supply shutoff member of an example fixing device.

The power supply shutoff member 104 is disposed on an outer peripheral side of the fixing belt 101 to shutoff the supply of power to the heat source 103 depending on the state of the fixing belt 101. With reference to FIG. 7, the power supply shutoff member 104 may include a thermostat which includes a bimetal 111 and shuts off the supply of power to the heat source 103 when the temperature of the bimetal 111 exceeds a threshold value. For example, when the fixing belt 101 thermally expands to contact the bimetal 111 of the power supply shutoff member 104 and the temperature of the bimetal 111 then exceeds the threshold value, the supply of power to the heat source 103 is shut off. A surface of the power supply shutoff member 104 to contact the thermally expanded fixing belt 101 may be defined as a detection surface 104*a*. The detection surface 104*a* of the power supply shutoff member 104 including the thermostat may include a surface that detects the temperature of the fixing belt 101, i.e., a surface on which the bimetal 111 is situated.

For example, when the temperature is below the threshold value, the bimetal is in a shape to connect electric lines to supply power to the heat source 103, as shown by a solid line in FIG. 7. Then, upon contact with the fixing belt 101 that has been expanded due to unusual heating, heat is conducted from the fixing belt 101 to the bimetal 111 to increase the temperature of the bimetal 111. Then, when the temperature has increased to exceed the threshold value, the bimetal 111 changes to a shape that disconnect the electric lines to supply power to the heat source 103, as shown by a dotted line in FIG. 7. The supply of power to the heat source 103 is shut off thereby.

A position of the fixing belt 101 at which the temperature caused by heating from the heat source 103 is maximum may be defined as a maximum temperature position MT. The maximum temperature position may be determined through experiments, simulations or the like. The power supply shutoff member 104 may be disposed in the vicinity of the maximum temperature position MT or in the vicinity of a position of the fixing belt 101 which has the maximum distance from the fixing nip part R3 (e.g. a position located substantially the farthest away from the fixing nip part R3). The position of the fixing belt 101 which is the farthest away from the fixing nip part R3 may be a position on a plane that extends through the rotation axis 101A of the fixing belt 101, a rotation axis 54A of the pressure roller 54 and the fixing nip part R3. The vicinity of the maximum temperature position MT may represent a position facing the maximum temperature position MT or a position in which the maximum temperature position MT is included in a detection area DA of the power supply shutoff member 104 (described further below). The vicinity of a position of the fixing belt 101 which is the farthest away from the fixing nip part R3 may represent a position that faces that position or a position at which that position is included in the detection area DA of the power supply shutoff member 104.

With reference to FIG. 2 to FIG. 5, the heat radiation plate 105 is disposed on an outer peripheral side of the fixing belt 101 to cover part of the fixing belt 101. The heat radiation plate 105 is disposed in a position which is separated from the fixing belt 101 before thermal expansion and at which it comes in contact with the fixing belt 101 upon thermal expansion. Upon contact with the thermally expanded fixing belt 101, the heat radiation plate 105 deprives the fixing belt 101 of heat to cool the fixing belt 101. For this reason, the thermal capacity of the heat radiation plate 105 per unit area is larger than the thermal capacity of the fixing belt 101 per unit area. The heat radiation plate 105 may comprise a metal or a resin. For example, the heat radiation plate 105 may be made of a metal, a resin, or a composite of a metal and a resin.

When the heat radiation plate 105 includes a metal, the metal material of the heat radiation plate 105 may include Al, Cu, SUS or an alloy containing at least one of these, to improve a high heat conductivity. When the heat radiation plate 105 includes a heat resistant resin, the resin material of the heat radiation plate 105 may include PI, PAI, PTFE, PEEK, LCP, PPS or a composition comprising at least one of these, to increase a high heat resistance.

The heat radiation plate 105 may have a curved profile that conforms with the thermally expanded fixing belt 101. For example, in a cross section orthogonal to the rotation axis 101A of the fixing belt 101, the heat radiation plate 105 may be formed in a curved profile that conforms with the fixing belt 101. The curved profile that conforms with the fixing belt 101 may have a profile different than the surface profile of the fixing belt 101 and still conform with the surface profile. For example, in a cross section orthogonal to the rotation axis 101A of the fixing belt 101, the fixing belt 101 may be formed in a deformed circle, while the heat radiation plate 105 may be formed in the shape of an arc of a true circle. In some examples, in a cross section orthogonal to the rotation axis 101A of the fixing belt 101, the heat radiation plate 105 is formed to have an arc shape (C-shaped) that covers part of the fixing belt 101. For example, the heat radiation plate 105 is in the form of a partly cut-away cylinder.

Figure 13:
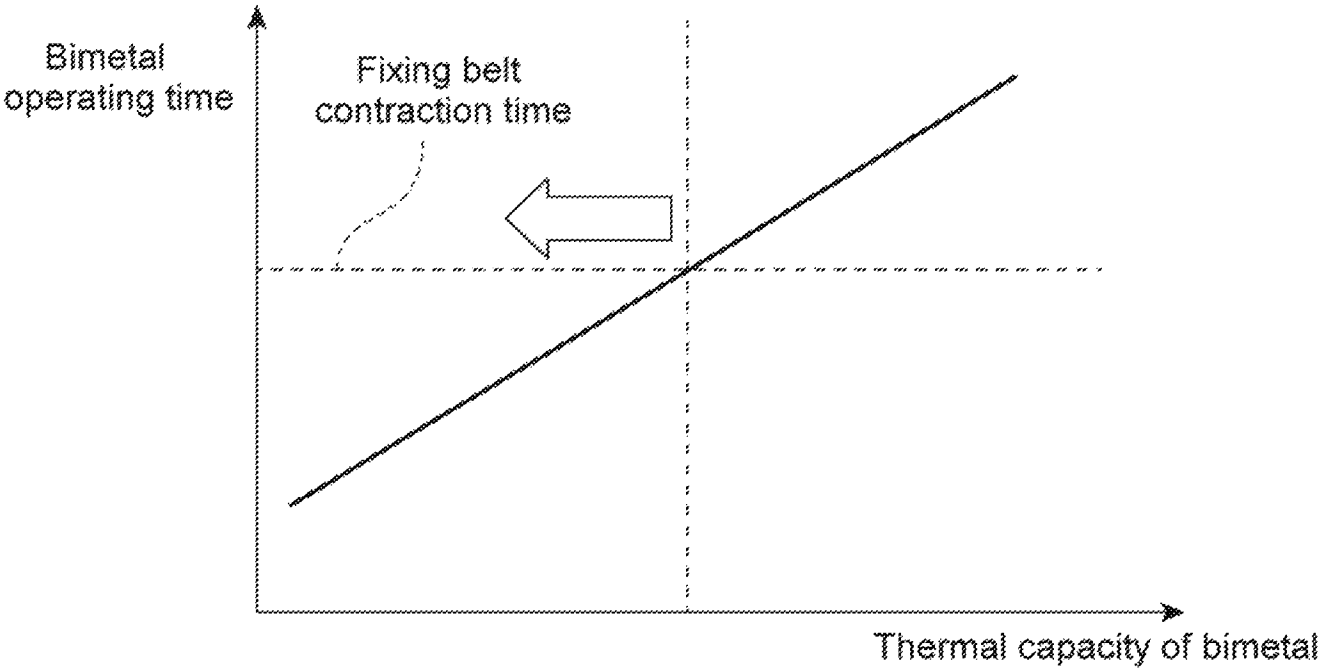
FIG. 13 is a graph showing a relationship between a thermal capacity of a bimetal, an operating time of the bimetal, and a contraction start time of an example fixing belt.

With reference to FIG. 13, the bimetal 111 may shut off the supply of power to the heat source 103 before the temperature of the fixing belt 101 reaches a temperature at which the fixing belt 101 contracts by the cooling of the fixing belt 101 with the heat radiation plate 105. In order to prevent the fixing belt 101 from contracting before the temperature of the bimetal 111 (power supply shutoff member 104) reaches an operating threshold value, it is effective to cool the fixing belt 101 at portions other than the portion at which the power supply shutoff member 104 comes in contact with the fixing belt 101. To this end, the heat radiation plate 105 and the power supply shutoff member 104 may be disposed along a same line extending (e.g. linearly) in the direction of the rotation axis 101A of the fixing belt 101 and on the same circle around the fixing belt 101. For example, the heat radiation plate 105 and the power supply shutoff member 104 may be disposed in overlapping positions when viewed along the rotation axis 101A of the fixing belt 101, and the heat radiation plate 105 and the power supply shutoff member 104 are disposed in overlapping positions when viewed along the peripheral direction of the fixing belt 101. An opening 105*a* is formed in the heat radiation plate 105 and the power supply shutoff member 104 is disposed in the opening 105*a*. The heat radiation plate 105 and the power supply shutoff member 104 may come in contact with each other, but may be separated from the viewpoint of manufacturability.

Figure 14:
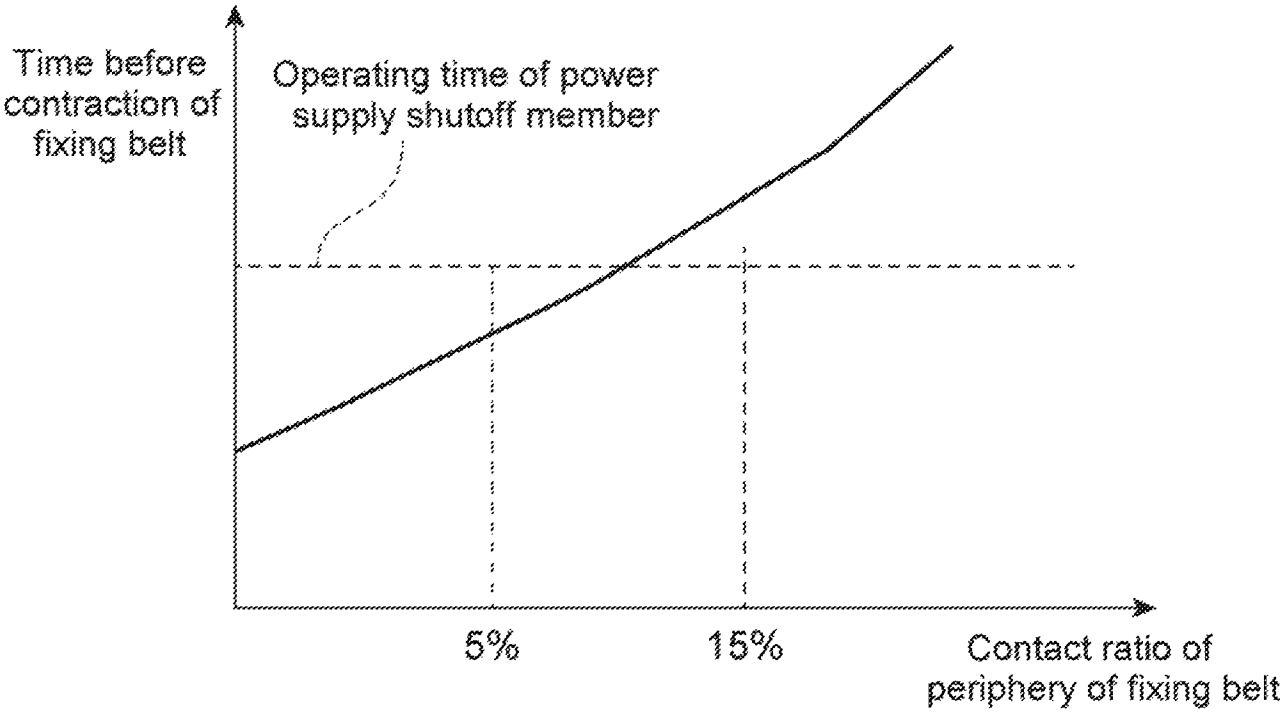
FIG. 14 is a graph showing a relationship between a contact ratio of the periphery of a fixing belt with a heat radiation plate and a contraction start time of the fixing belt.
Figure 15:
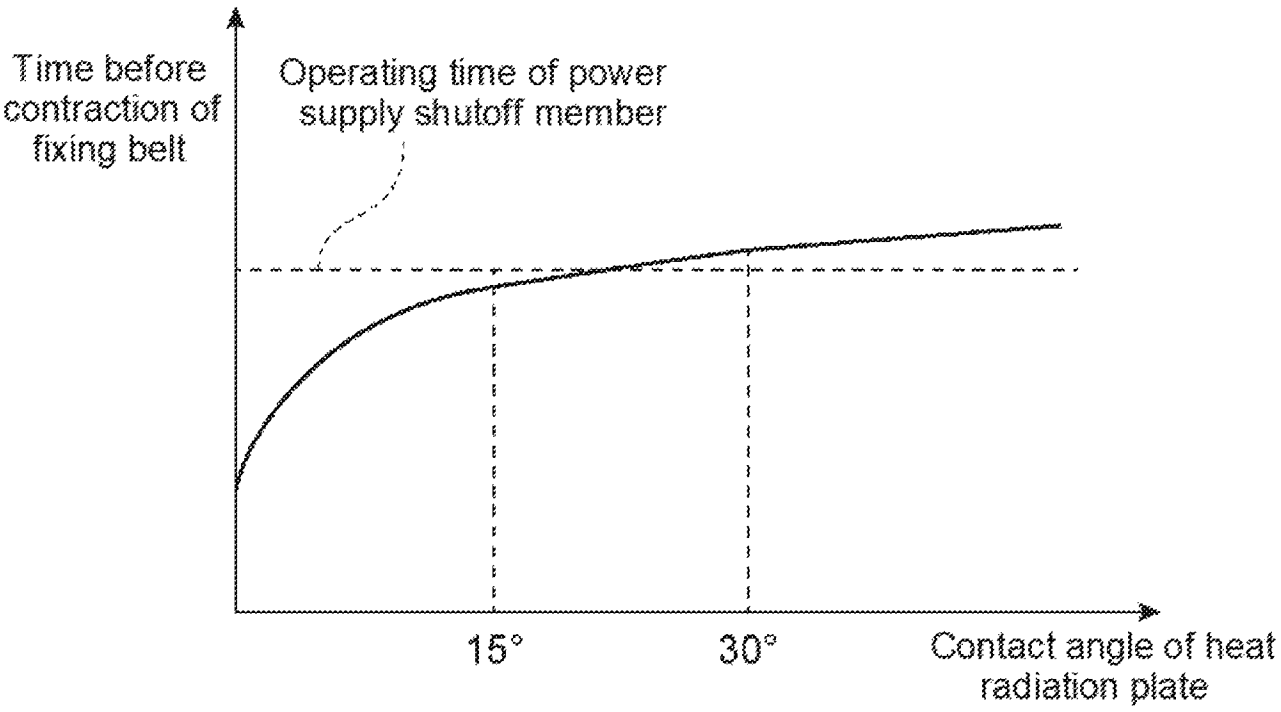
FIG. 15 is a graph showing a relationship between a contact angle of a heat radiation plate relative to a fixing belt and a contraction start time of the fixing belt.

FIG. 14 shows test results performed with a sample fixing device that was used to examine a relation between a contact ratio of the periphery of the fixing belt 101 with the heat radiation plate 105 and a contraction start time of the fixing belt 101. As shown in FIG. 14, when the contact ratio is 10% or more, the contraction start time of the fixing belt 101 is later than the time at which the power supply shutoff member 104 operates. This may be because a sufficient amount of heat conduction is available from the fixing belt 101 to the heat radiation plate 105 when the contact ratio is 10% or more. In addition, a relation between a contact angle of the heat radiation plate 105 relative to the fixing belt 101 and a contraction start time of the fixing belt 101 was investigated and substantially the same result as FIG. 14 was obtained, as shown in FIG. 15.

In view of the above results, in the peripheral direction of the fixing belt 101, an area of the fixing belt 101 covered by the heat radiation plate 105 may be 10% or more of the peripheral length of the fixing belt 101 in some examples, or 15% or more of the peripheral length of the fixing belt 101 in other examples, for gaining a heat conduction amount from the fixing belt 101 to the heat radiation plate 105. In the peripheral direction of the fixing belt 101, the area of the fixing belt 101 covered by the heat radiation plate 105 is 70% or less of the peripheral length of the fixing belt 101 in some example, or 60% or less of the peripheral length of the fixing belt 101 in other examples, to suppress the heat radiation plate 105 from becoming large in size. Still in the peripheral direction of the fixing belt 101, the area of the fixing belt 101 covered by the heat radiation plate 105 relative to the peripheral length of the fixing belt 101, is 10% or more and 70% or less in some examples, or 15% or more and 60% or less in other examples. The peripheral direction of the fixing belt 101 may refer to a direction around the rotation axis 101A of the fixing belt 101.

Figure 8:
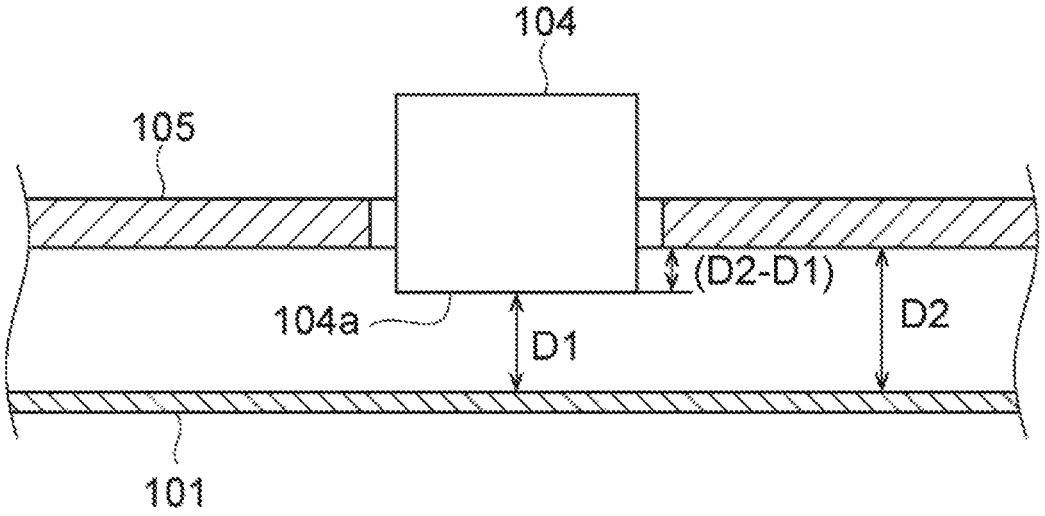
FIG. 8 is a diagram schematically illustrating relative positions of a fixing belt, a power supply shutoff member, and a heat radiation plate of an example fixing device.

With reference to FIG. 8, a minimum distance D1 between the fixing belt 101 before thermal expansion and the detection surface 104*a* may be shorter than a minimum distance D2 between the fixing belt 101 before thermal expansion and the heat radiation plate 105. For example, the power supply shutoff member 104 may project from the heat radiation plate 105 so that the detection surface 104*a* is disposed at a position that is projected from the heat radiation plate 105.

Figure 16:
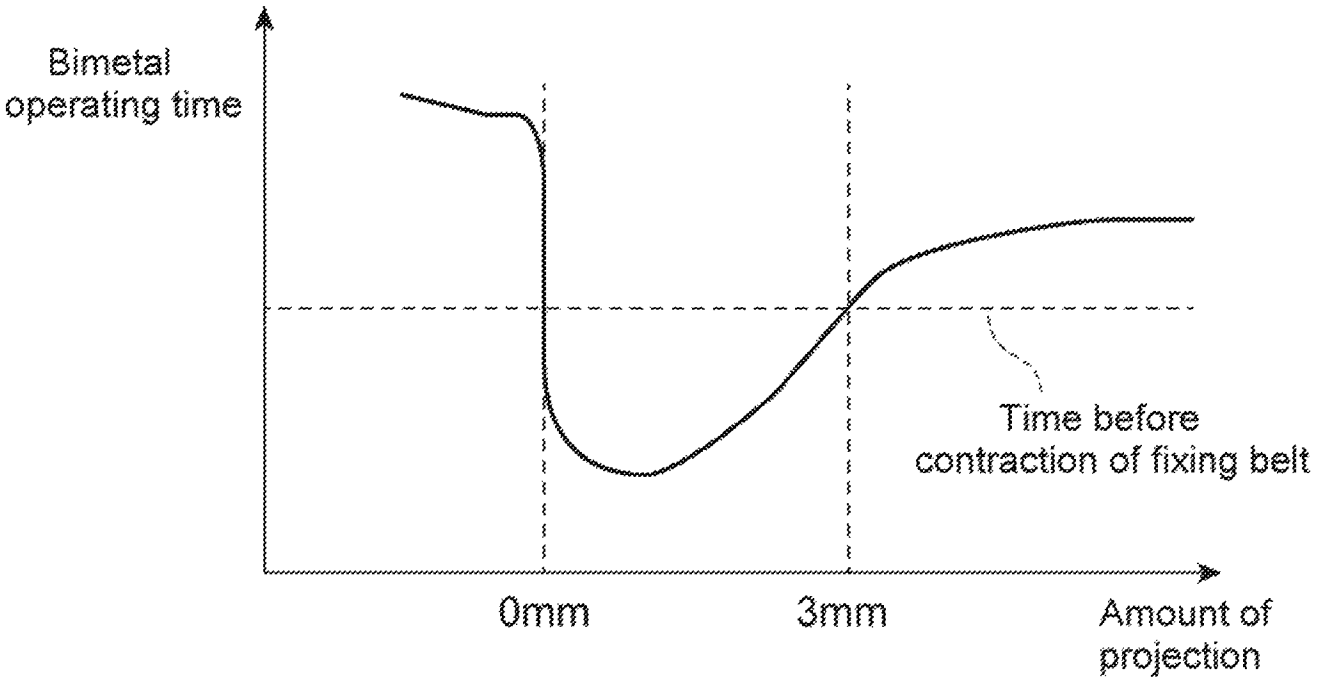
FIG. 16 is a graph showing a relationship between an amount of projection of a power supply shutoff member relative to a heat radiation plate and an operating time of a bimetal.

FIG. 16 shows test results performed with a fixing device that was used to examine a relation between a projection amount of the power supply shutoff member 104 (detection surface 104*a*) relative to the heat radiation plate 105 and an operating time of the bimetal 111. As shown in FIG. 16, when the power supply shutoff member 104 is projected from the heat radiation plate 105, the operating time of the bimetal 111 decreases. When the amount of projection of the power supply shutoff member 104 relative to the heat radiation plate 105 becomes excessive, the operating time of the bimetal 111 increases gradually. In view of these, the difference between the minimum distance D1 between the fixing belt 101 before thermal expansion and the detection surface 104*a* and the minimum distance D2 between the fixing belt 101 before thermal expansion and the heat radiation plate 105 (D2−D1) may be 3.0 mm or less in some examples, or 2.0 mm or less in other examples, to shorten the time required for the fixing belt 101 to make contact with the heat radiation plate 105 after making contact with the detection surface 104*a*. This difference (D2−D1) may be larger than 0 mm, in order to more reliably abut the fixing belt 101 against the power supply shutoff member 104.

The minimum distance D1 between the fixing belt 101 before thermal expansion and the power supply shutoff member 104 may be 1.0 mm or more and 3.0 mm or less in some examples, or 1.5 mm or more and 2.5 mm or less in other examples, in order to detect the temperature of the fixing belt 101 earlier at the time of unusual heating, without obstructing the rotation of the fixing belt 101 by the power supply shutoff member 104 during normal operation.

The minimum distance D2 between the fixing belt 101 before thermal expansion and the heat radiation plate 105 may be 5 mm or less in some examples, or 4 mm or less in some examples, for the thermally expanded fixing belt 101 to contact the heat radiation plate 105 before contraction.

Figure 9:
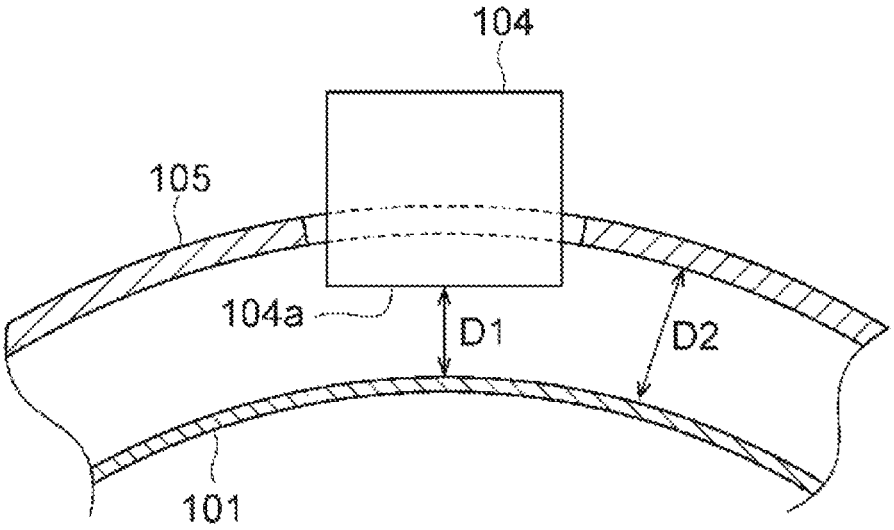
FIG. 9 is a diagram schematically illustrating relative positions of a fixing belt, a power supply shutoff member, and a heat radiation plate of an example fixing device.

With reference to FIG. 9, where the minimum distance between the fixing belt 101 before thermal expansion and the power supply shutoff member 104 varies along the peripheral direction of the fixing belt 101, a shortest distance is taken as the minimum distance D1. If the minimum distance D2 between the fixing belt 101 before thermal expansion and the heat radiation plate 105 varies along the peripheral direction of the fixing belt 101, a distance at a position that is closest to the power supply shutoff member 104 is taken as the minimum distance D2.

Figure 10:
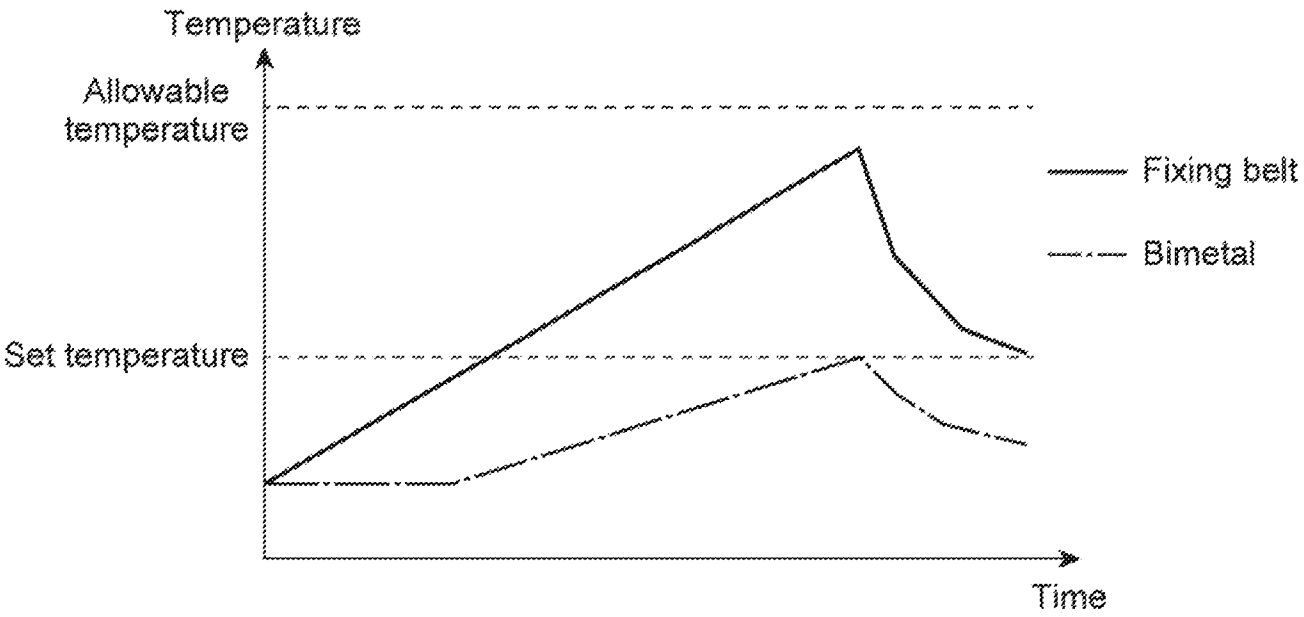
FIG. 10 is a graph illustrating temperatures of a thermally expandable fixing belt and of a bimetal of a power supply shutoff member, in time, for a fixing device of a comparative example.

FIG. 10 shows operations of a fixing belt and a power supply shutoff member in a fixing device of a comparative example where the heat radiation plate is not provided, based on an assumption that the fixing belt does not contract.

As shown in FIG. 10, in this comparative example, upon unusual heating of the fixing belt, the fixing belt thermally expands and contacts the bimetal of the power supply shutoff member. The temperature of the bimetal thus starts to increase. After that, when the temperature of the bimetal exceeds a threshold value, the supply of power to the heat source is shut off and the temperature of the fixing belt decreases.

Figure 11:
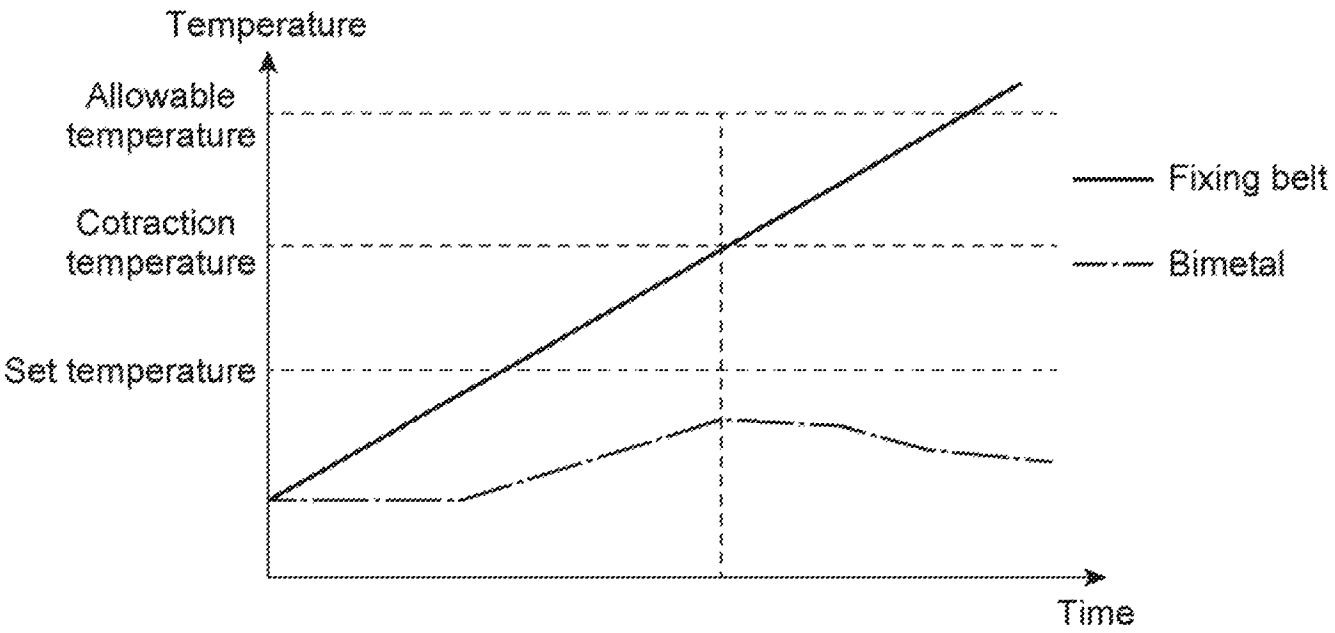
FIG. 11 is a graph illustrating temperatures of a thermally expandable fixing belt and of a bimetal of a power supply shutoff member, in time, for a fixing device of a comparative example.

The fixing belt contracts when the thermal expansion continues. In the comparative example, therefore, when the thermally expanded fixing belt contacts the bimetal of the power supply shutoff member, the temperature of the bimetal starts to increase but the fixing belt reaches a contraction temperature before the temperature of the bimetal exceeds the threshold value, as shown in FIG. 11. The contraction temperature is a temperature at which the thermally expanded fixing belt contracts. Because of the contraction of the fixing belt, the temperature of the bimetal does not increase to shut off the supply of power to the heat source, and the temperature of the fixing belt continues to rise. As a result, an allowable temperature tolerable for the fixing belt is eventually exceeded. If the allowable temperature is exceeded, the fixing belt may cause ignition (e.g. flaming).

Figure 12:
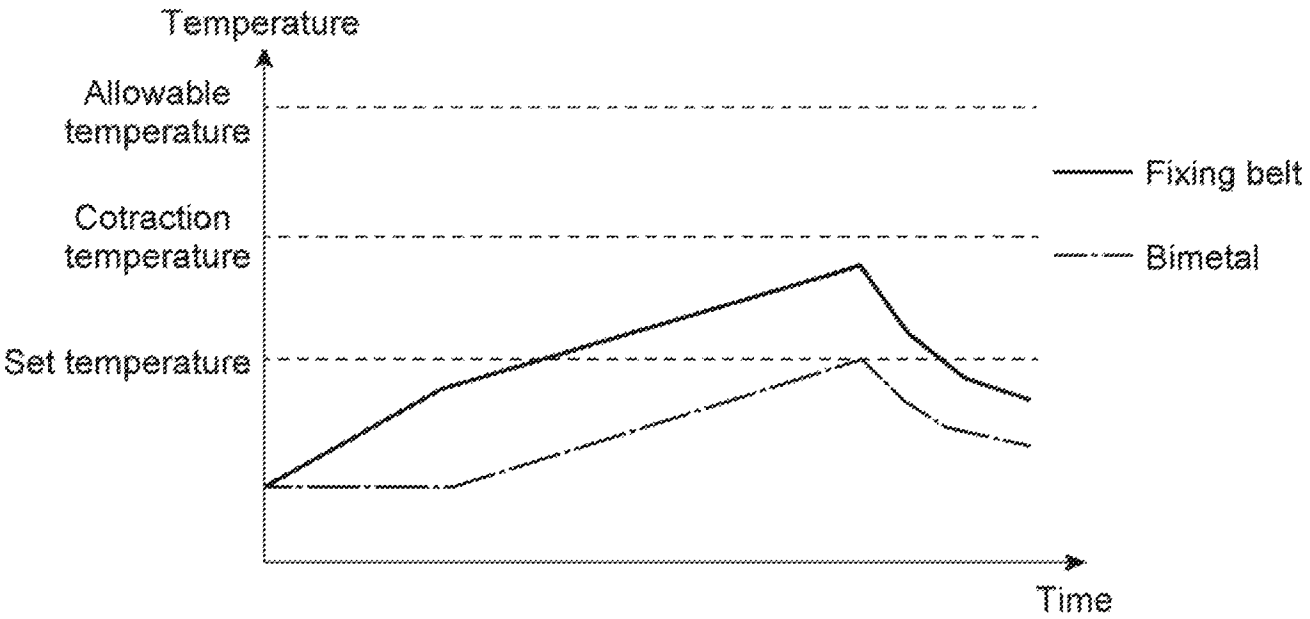
FIG. 12 is a graph illustrating temperatures of a thermally expandable fixing belt and of a bimetal of a power supply shutoff member, in time, for an example fixing device.

In example fixing devices 50, after making contact with the bimetal 111 of the power supply shutoff member 104, the thermally expanded fixing belt 101 exhibits a slower temperature increase rate as it makes contact with the heat radiation plate 105, as shown in FIG. 12. As the time required for the fixing belt 101 to reach the contraction temperature is prolonged thereby, the temperature of the bimetal 111 exceeds the threshold value before the fixing belt 101 reaches the contraction temperature. Accordingly, the supply of power to the heat source 103 is shut off and the temperature of the fixing belt 101 decreases.

In this manner, the heat radiation plate 105 that covers part of the fixing belt 101 is disposed on an outer peripheral side of the fixing belt 101 in a position separated from the fixing belt 101 (e.g., spaced away from the fixing belt 101) before thermal expansion and at which it comes in contact with the fixing belt 101 upon thermal expansion. Accordingly, the fixing belt 101 can rotate without being obstructed by the heat radiation plate 105 before the fixing belt 101 thermally expands. When the fixing belt 101 thermally expands, the fixing belt 101 can contact the heat radiation plate 105 to dissipate heat to the heat radiation plate 105. The time required for the fixing belt 101 to contract can be thereby prolonged. Hence, the supply of power to the heat source 103 can be shut off by the power supply shutoff member 104 before the fixing belt 101 contracts.

In examples where the power supply shutoff member 104 is a thermostat that uses the bimetal 111, it does not operate immediately after contact with the fixing belt 101, but operates when a predetermined time has passed from the contact with the fixing belt 101. For example, the power supply shutoff member 104 operates for the first time when the fixing belt 101 contacts the bimetal 111, heat is conducted from the fixing belt 101 to the bimetal 111, and the temperature of the bimetal 111 exceeds the threshold value. In the example fixing device 50, as the time until the contraction of the fixing belt 101 can be prolonged, the time the thermally expanded fixing belt 101 contacts the power supply shutoff member 104 can be prolonged. Accordingly, even in a comparative fixing devices where the fixing belt contracts before the operation of the power supply shutoff member, the contraction of the fixing belt 101 before the operation of the power supply shutoff member 104 can be suppressed.

In addition, when the minimum distance D2 between the fixing belt 101 before thermal expansion and the heat radiation plate 105 is 5 mm or less, the thermally expanded fixing belt 101 can contact the heat radiation plate 105 before contraction.

In some examples, as the heat radiation plate 105 has a curved profile that conforms with the thermally expanded fixing belt 101, the area of contact of the fixing belt 101 with the heat radiation plate 105 can be increased. This enables to increase the amount of heat conducted from the fixing belt 101 to the heat radiation plate 105.

In some examples, when the heat radiation plate 105 includes a metal, the amount of heat conducted from the fixing belt 101 to the heat radiation plate 105 can be increased, as compared with a case where the heat radiation plate 105 is made of a resin. Accordingly, when the metal material of the heat radiation plate 105 is Al, Cu, SUS or an alloy containing at least one of these, the heat conductivity of the heat radiation plate 105 can be further increased.

In some examples, when the heat radiation plate 105 includes a heat resistant resin, the workability of the heat radiation plate can be improved as compared to a case where the heat radiation plate 105 is made of a metal. Accordingly, when the resin material of the heat radiation plate 105 is PI, PAI, PTFE, PEEK, LCP, PPS or a composition including at least one of these, the heat resistance of the heat radiation plate 105 can be further increased.

In some examples, when the heat radiation plate 105 and the power supply shutoff member 104 are disposed along the same line extending in the direction of the rotation axis 101A of the fixing belt 101, the thermally expanded fixing belt 101 can contact the power supply shutoff member 104 while dissipating heat also along the line from the thermally expanded fixing belt 101 to the heat radiation plate 105.

In some examples, when the power supply shutoff member 104 is disposed in an opening 105*a* formed in the heat radiation plate 105, the heat radiation plate 105 can be prevented from being interposed between the power supply shutoff member 104 and the fixing belt 101, in order to for the thermally expanded fixing belt 101 to directly contact the power supply shutoff member 104.

In some examples, as the amount of deviation of the fixing belt 101 caused by the expansion is the largest in a position of the fixing belt 101 which is most separated away (e.g., is farthest away) from the fixing nip part in most fixing devices, the power supply shutoff member 104 can be better operated when the power supply shutoff member 104 is disposed in the vicinity of that position.

In some examples, when the power supply shutoff member 104 is disposed in the vicinity of the maximum temperature position, the power supply shutoff member 104 can be better operated.

In some examples, when the minimum distance between the fixing belt 101 before thermal expansion and the detection surface 104*a* is shorter than the minimum distance between the fixing belt 101 before thermal expansion and the heat radiation plate 105, the thermally expanded fixing belt 101 can contact the detection surface 104*a* earlier than the heat radiation plate 105, to operate the power supply shutoff member 104 earlier.

In some examples, when the difference between the minimum distance D1 between the fixing belt 101 before thermal expansion and the detection surface 104*a* and the minimum distance D2 between the fixing belt 101 before thermal expansion and the heat radiation plate 105 is 3 mm or less, the fixing belt 101 can still contact the heat radiation plate 105 even if the thermally expanded fixing belt 101 contacts the detection surface 104*a* earlier, to better suppress contraction of the fixing belt 101.

In some examples, when the thermal capacity of the heat radiation plate 105 per unit area is larger than the thermal capacity of the fixing belt 101 per unit area, the heat transfer efficiency from the fixing belt 101 to the heat radiation plate 105 can be increased.

In some examples, when the area of the fixing belt 101 covered by the heat radiation plate 105 is 10% or more of the peripheral length of the fixing belt 101, heat can be better dissipated from the fixing belt 101 to the heat radiation plate 105. When the area of the fixing belt 101 covered by the heat radiation plate 105 is 70% or less of the peripheral length of the fixing belt 101, the heat radiation plate 105 can be minimized in size (e.g., the heat radiation plate 105 can be prevented from becoming large in size).

In some examples, when the heat source 103 is a halogen lamp, the fixing belt 101 can be heated easily and the heating can be more easily controlled.

A surface of the heat radiation plate 105 facing the fixing belt 101 may be a reflection surface that reflects radiant heat from the fixing belt 101 back to the fixing belt 101. With this, the heating efficiency of the fixing belt 101 can be enhanced during a normal operation in which the fixing belt 101 is not thermally expanded. When the reflection surface is a mirror surface, radiant heat from the fixing belt 101 can be reflected to the fixing belt 101 more efficiently.

In some examples, as the contraction of the fixing belt 101 depends on the temperature of the fixing belt 101, the contraction of the fixing belt 101 can be better suppressed when the power supply shutoff member 104 is a thermostat.

In some examples, when the base layer 101*a* of the fixing belt 101 is made of a resin, a nip-shape following property of the fixing belt 101 can be increased.

In some examples, when the resin material of the base layer 101*a* is PI, PEEK, PAI or a composition comprising at least one of these, the heat resistance of the fixing belt 101 can be enhanced.

In some examples, when the thickness of the base layer 101*a* made of a resin is 150 μm or less, the heat conductivity can be suppressed from decreasing, while suppressing decrease in the nip-shape following property of the fixing belt 101.

In some examples, when the heat conductivity of the base layer 101*a* made of a resin is 2.0 W/mK or less, the durability property of the base layer 101*a* can be suppressed from decreasing.

In some examples, when the base layer of the fixing belt 101 is made of a metal, the durability and stiffness of the fixing belt 101 can be increased.

In some examples, when the metal material of the base layer 101*a* is SUS, Cu, Ni or an alloy containing at least one of these, the heat conductivity of the base layer can be increased.

In some examples, when the thickness of the base layer made of a metal is 70 μm or less, the heat conductivity can be suppressed from decreasing, while suppressing decrease in the nip-shape following property of the fixing belt 101.

In some examples, when the thermal expansion coefficient of the base layer 101*a* is $1.0\times10^{-5}$ m/K or more, the nip-shape following property of the fixing belt 101 can be increased. When the thermal expansion coefficient of the base layer 101*a* is $100\times10^{-5}$ m/K or less, easy expansion and premature contraction of the fixing belt 101 can be suppressed.

Figure 17:
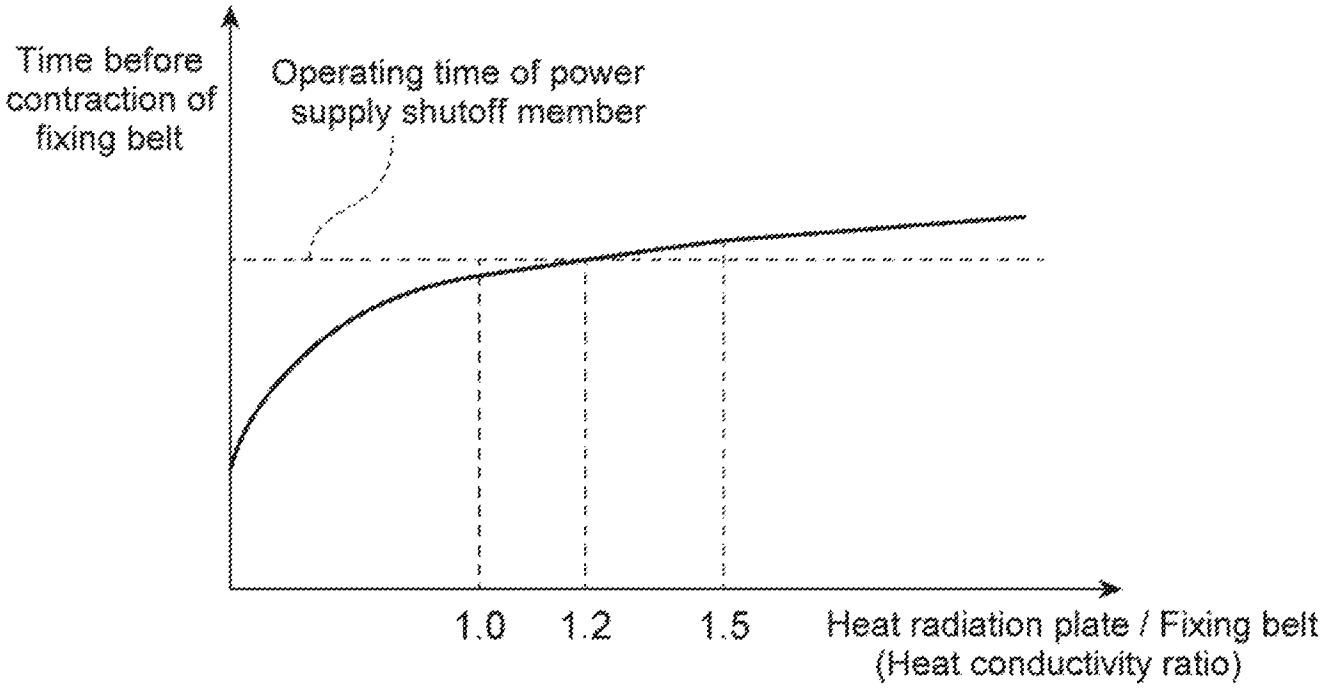
FIG. 17 is a graph showing a relationship between a heat conductivity ratio and a contraction start time of the fixing belt.

FIG. 17 shows test results performed with a sample fixing device that was used to examine a relation between a ratio of the heat conductivity of the heat radiation plate 105 to the heat conductivity of the fixing belt 101 (where the heat conductivity ratio is defined by a ratio of the heat conductivity of the heat radiation plate 105 to the heat conductivity of the fixing belt 101) and a contraction start time of the fixing belt 101. As shown in FIG. 17, when the heat conductivity ratio is 1.2 or more, the contraction start time of the fixing belt 101 is later than the time at which the power supply shutoff member 104 operates. This may be because a heat conduction efficiency from the fixing belt 101 to the heat radiation plate 105 can be increased when the heat conductivity ratio is 1.2 or more. In view of this, the heat conductivity ratio of the heat conductivity of the heat radiation plate 105 to the heat conductivity of the fixing belt 101 may be 1.2 or more in some examples, or 1.5 or more in other examples.

Figure 18:
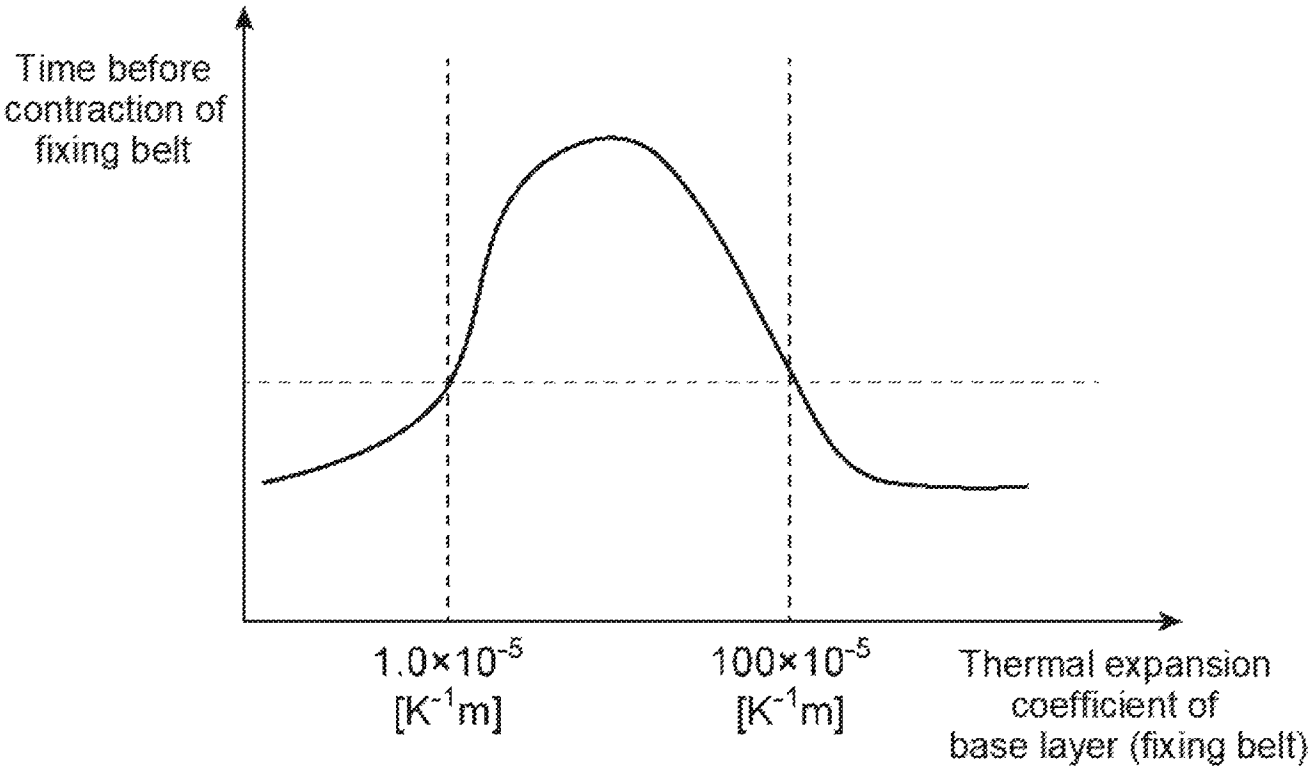
FIG. 18 is a graph showing a relationship between a thermal expansion coefficient of a base layer and a contraction start time of the fixing belt.

FIG. 18 shows test results performed with a sample fixing device that was used to examine a relation between a thermal expansion coefficient of the base layer 101*a* and a contraction start time of the fixing belt 101. As shown in FIG. 18, when the thermal expansion coefficient of the base layer 101*a* is $1.0\times10^{-5}$ m/K or more and $100\times10^{-5}$ m/K or less, the contraction start time of the fixing belt 101 delays. When the thermal expansion coefficient of the base layer 101*a* is less than $1.0\times10^{-5}$ m/K, the expansion of the fixing belt 101 is small and the nip-shape following property of the fixing belt 101 is lowered, thereby decreasing the contact pressure between the fixing belt 101 and the heat radiation plate 105. The heat conduction efficiency from the fixing belt 101 to the heat radiation plate 105 is thereby deteriorated, and the contraction start time of the fixing belt 101 may have been advanced thereby. Further, when the thermal expansion coefficient of the base layer is $100\times10^{-5}$ m/K or more, the rigidity of the fixing belt 101 is too small and the contraction start time of the fixing belt 101 may have been advanced thereby.

Accordingly, the thermal expansion coefficient of the base layer 101*a* may be $1.0\times10^{-5}$ m/K or more in some examples, or $5.0\times10^{-5}$ m/K or more in other examples, to suppress a decrease in the nip-shape following property of the fixing belt 101. The thermal expansion coefficient of the base layer 101*a* may be $100\times10^{-5}$ m/K or less in some examples, or $70\times10^{-5}$ m/K or less in other examples, to suppress an easy expansion and premature contraction of the fixing belt. For example, the thermal expansion coefficient of the base layer 101*a* may be $1.0\times10^{-5}$ m/K or more and $100\times10^{-5}$ m/K or less in some examples, or $5.0\times10^{-5}$ m/K or more and $70\times10^{-5}$ m/K or less in other examples.

Figure 19:
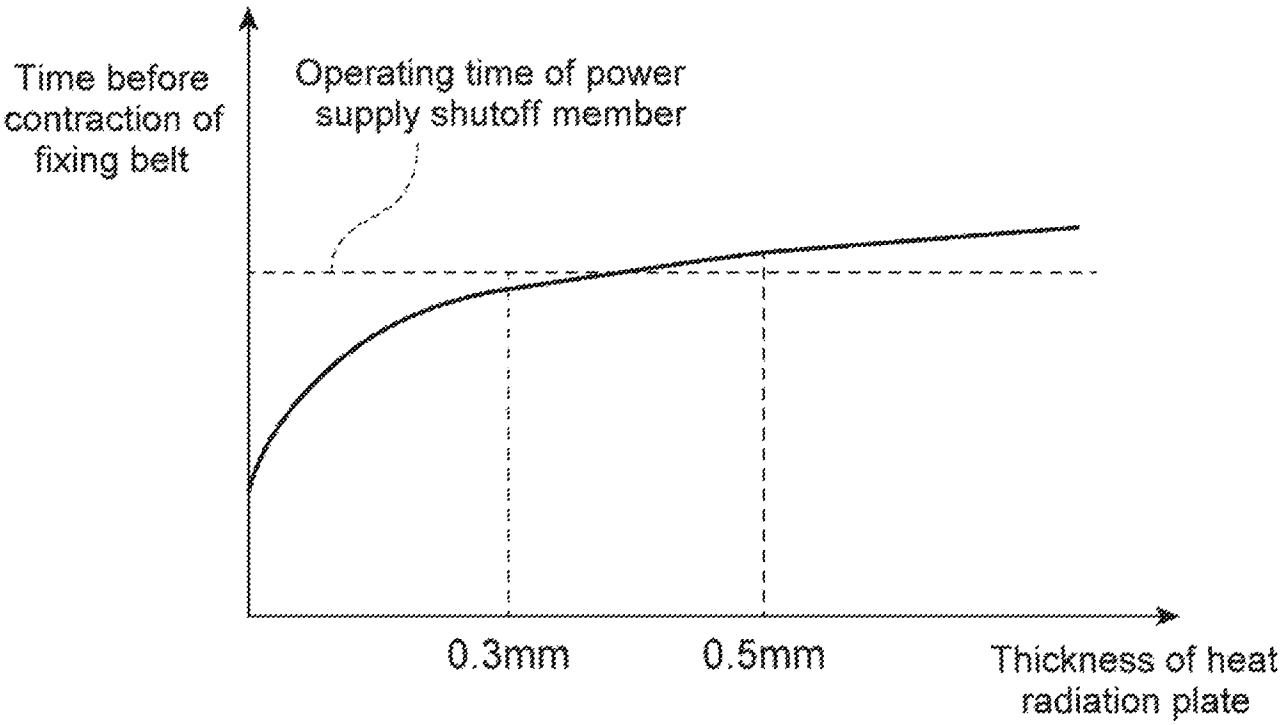
FIG. 19 is a graph showing a relationship between a thickness of a heat radiation plate and a contraction start time of a fixing belt.

FIG. 19 shows test results performed with a sample fixing device that was used to examine a relation between a thickness of the heat radiation plate 105 and a contraction start time of the fixing belt 101. As shown in FIG. 19, when the thickness of the heat radiation plate 105 is 0.4 mm or more, the contraction start time of the fixing belt 101 is delayed. In view of this, the thickness of the heat radiation plate 105 may be 0.4 mm or more in some examples, and 0.5 mm or more in other examples.

In some examples, a surface of the heat radiation plate 105 facing the fixing belt 101 may be provided with an adhesive. The thermally expanded fixing belt 101 can thereby abut to the heat radiation plate 105 and bond to the heat radiation plate 105. This increases the adhesion between the heat radiation plate 105 and the fixing belt 101, and the heat conductivity from the fixing belt 101 to the heat radiation plate 105 can be increased.

The contraction of the fixing belt 101 depends not only on the temperature of the fixing belt 101, but also the amount of expansion of the fixing belt.

Figure 20:
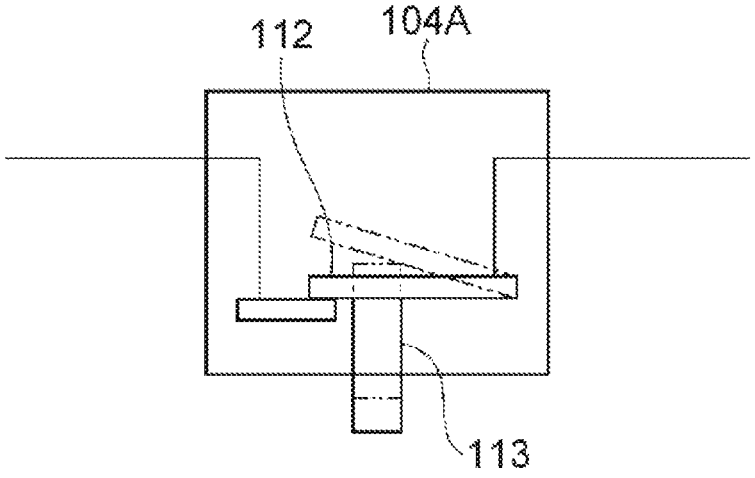
FIG. 20 is a schematic view of a pressure sensitive circuit breaker, which is a power supply shutoff member of an example fixing device.

With reference to FIG. 20, an example fixing device has a power supply shutoff member 104A that includes a pressure-sensitive circuit breaker which, when pushed by the thermally expanded fixing belt 101, shuts off the supply of power to the heat source 103. The power supply shutoff member 104A includes a switch 112 to turn on and off electric lines to supply power to the heat source 103 and a pin 113 projected from the power supply shutoff member 104A. During a normal operation where the fixing belt 101 is not thermally expanded, the electric lines to supply power to the heat source 103 are connected by the switch 112. Then, when the fixing belt 101 thermally expands, the fixing belt 101 presses the pin 113 and the pin 113 in turn presses the switch 112 to disconnect the electric lines to supply power to the heat source 103. The supply of power to the heat source 103 is shut off thereby.

Accordingly, the use of the pressure-sensitive circuit breaker as the power supply shutoff member 104A enables to control the contraction of the fixing belt 101.

It is to be understood that not all aspects, advantages and features described herein may necessarily be achieved by, or included in, any one particular example. Indeed, having described and illustrated various examples herein, it should be apparent that other examples may be modified in arrangement and detail.

Figure 21:
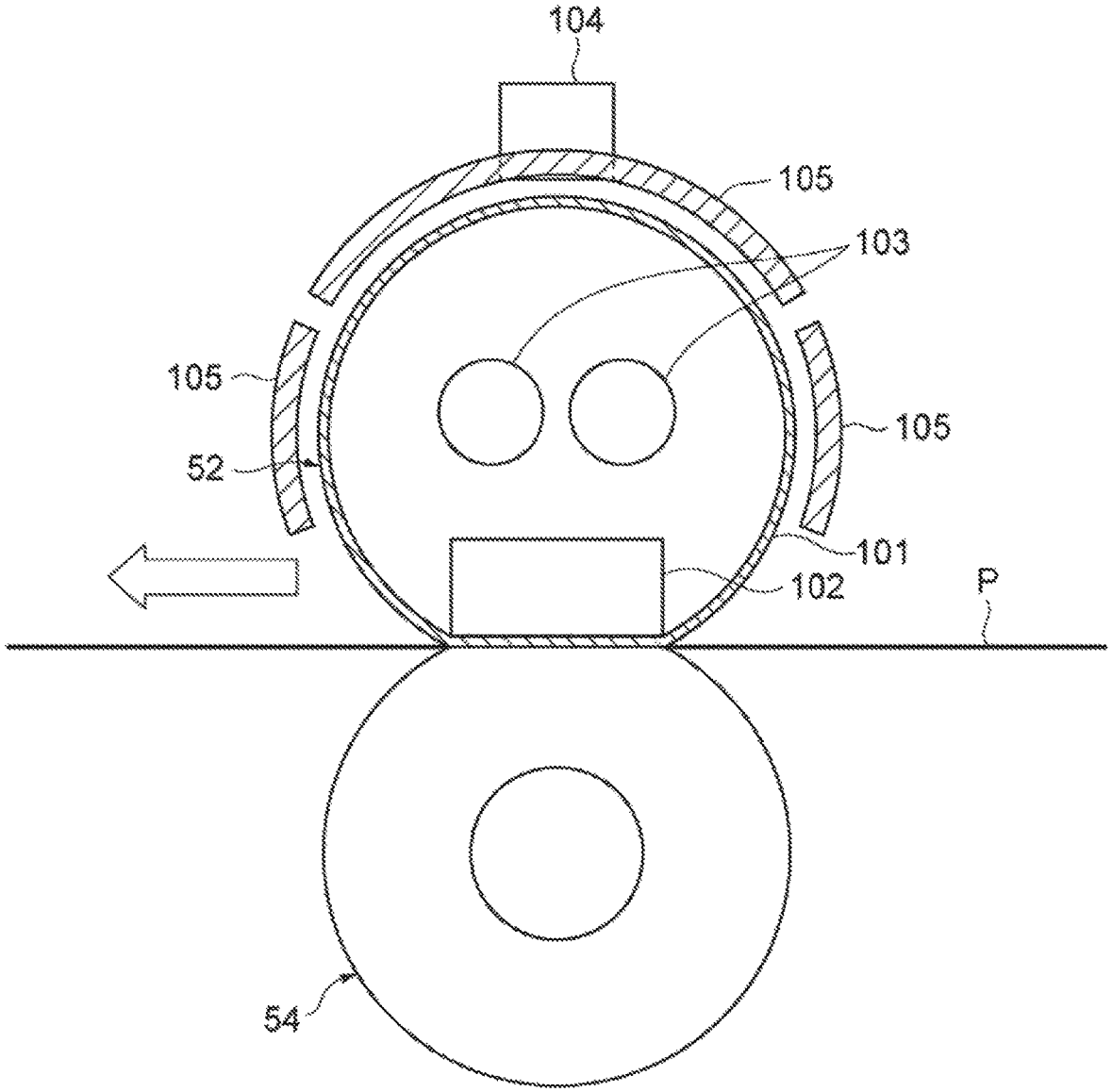
FIG. 21 is a schematic cross-sectional view of an example fixing device having a heat radiation plate.

For example, a plurality of the heat radiation plate 105 may be provided in the peripheral direction of the fixing belt, as shown in FIG. 21. The plurality of heat radiation plates 105 may be provided in the direction of the rotation axis 101A of the fixing belt 101 or in the peripheral direction of the fixing belt 101. The plurality of heat radiation plates 105 may be abutted one with respect to the other or spaced apart from each other. The heat radiation plates 105 may be disposed in accordance with the arrangement or the like of peripheral devices around the fixing belt 101. This enables to increase the degree of freedom of disposing the heat radiation plate 105.

Figure 22:
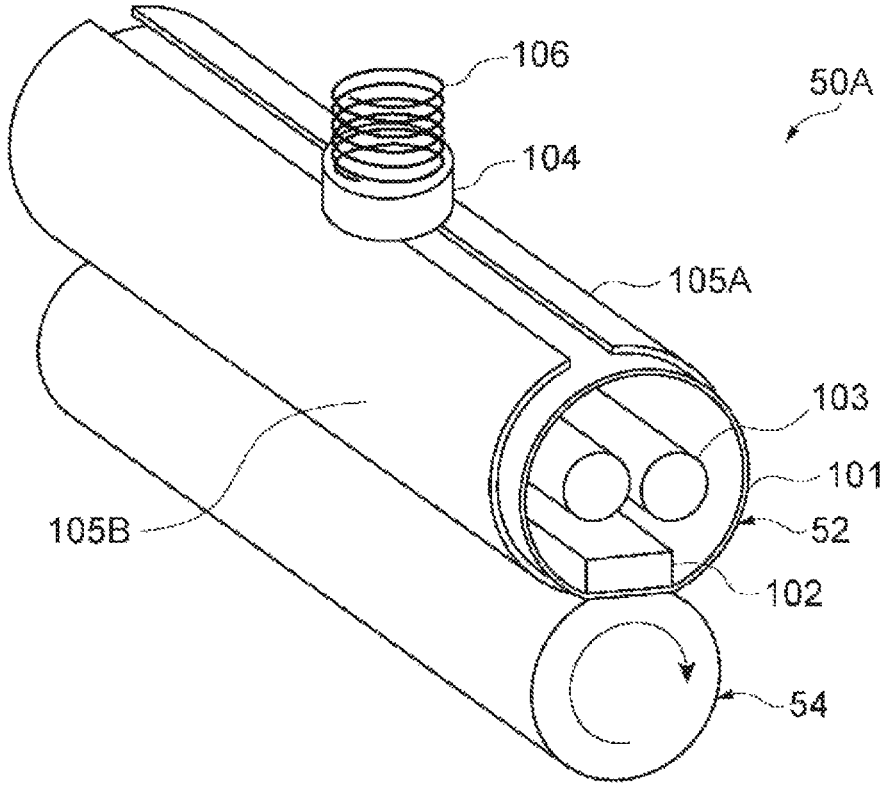
FIG. 22 is a schematic perspective view of an example fixing device.
Figure 23:
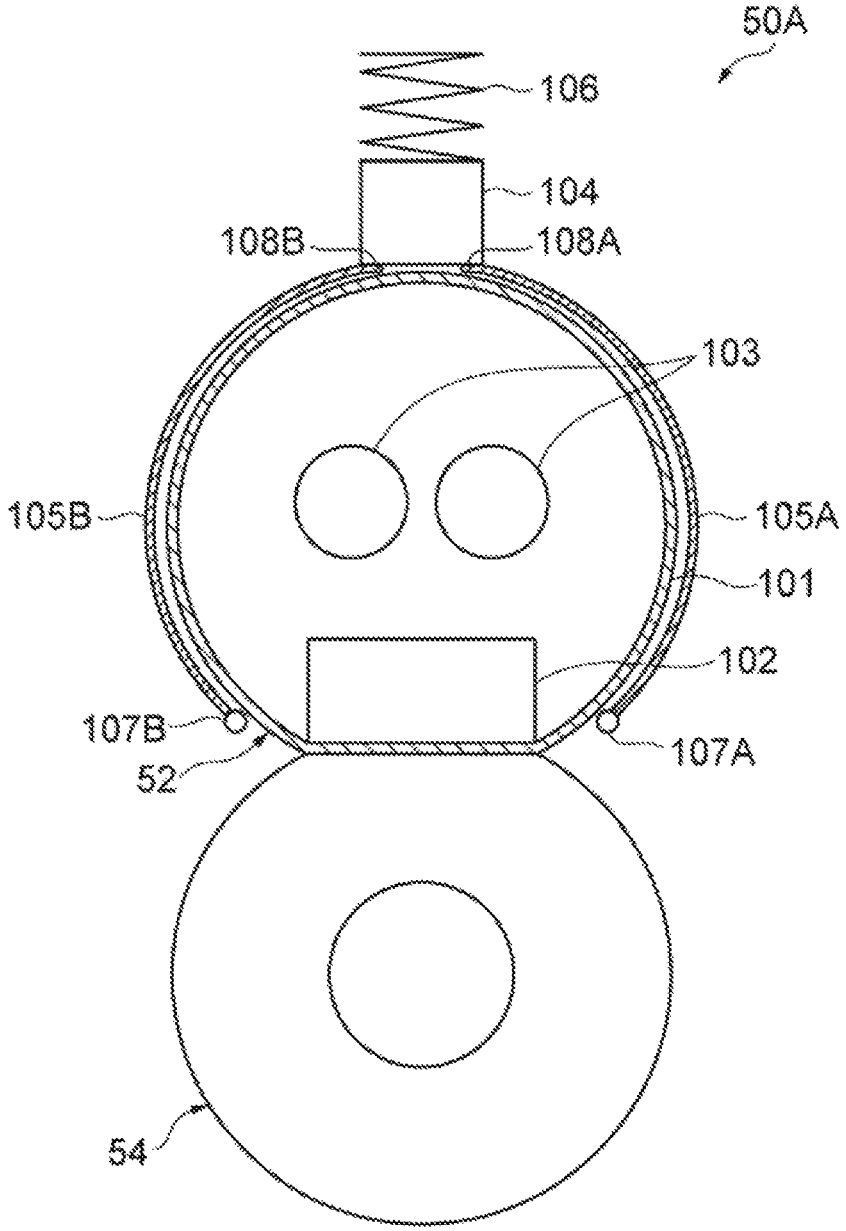
FIG. 23 is a schematic cross-sectional view of the example fixing device shown in FIG. 23.

With reference to FIG. 22 to FIG. 29, in an example fixing device 50A, the power supply shutoff member is latched by divided heat radiation plate and pushed toward the fixing belt by an elastic member. [0154] As shown in FIG. 22 and FIG. 23, the example fixing device 50A includes the fixing belt 101, the heater roller 52 having the pusher member 102 and the heat source 103, the pressure roller 54, the power supply shutoff member 104, the heat radiation plate 105 having a first heat radiation plate 105A and a second heat radiation plate 105B, and an elastic member 106.

Figure 24:
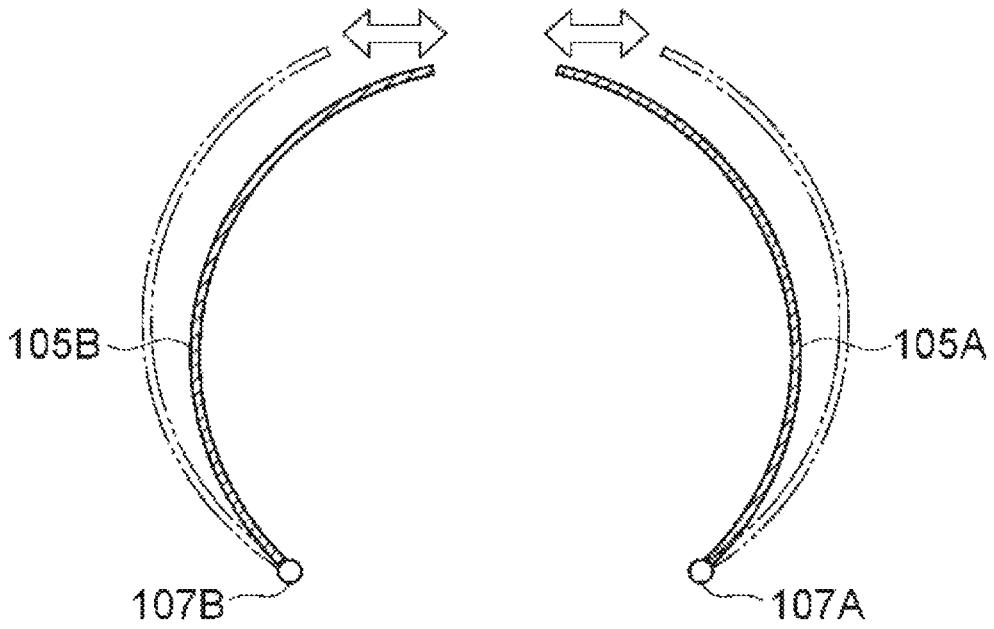
FIG. 24 is a diagram schematically illustrating a pivotable structure of a first heat radiation plate and a second heat radiation plate in an example fixing device.

As shown in FIG. 22 to FIG. 24, the first heat radiation plate 105A and the second heat radiation plate 105B are divided in the peripheral direction of the fixing belt 101 and disposed to contact with or separate from each other. The first heat radiation plate 105A and the second heat radiation plate 105B are similar to the heat radiation plate 105 illustrated in FIGS. 2 to 5. The first heat radiation plate 105A and the second heat radiation plate 105B latch the power supply shutoff member 104 from the side of the fixing belt 101. For example, the power supply shutoff member 104 is latched by both of the first heat radiation plate 105A and the second heat radiation plate 105B from the side of the fixing belt 101.

In the peripheral direction of the fixing belt 101, the first heat radiation plate 105A extends toward one side from the power supply shutoff member 104. The second heat radiation plate 105B extends toward the other side from the power supply shutoff member 104, in the peripheral direction of the fixing belt 101. The first heat radiation plate 105A and the second heat radiation plate 105B extend from the power supply shutoff member 104 in opposite directions in the peripheral direction of the fixing belt 101. The power supply shutoff member 104 is latched by an end of the first heat radiation plate 105A facing the second heat radiation plate 105B and an end of the second heat radiation plate 105B facing the first heat radiation plate 105A. A latching surface 108A of the first heat radiation plate 105A to latch the power supply shutoff member 104 is a surface of the first heat radiation plate 105A facing away from the fixing belt 101. A latching surface 1086 of the second heat radiation plate 105B to latch the power supply shutoff member 104 is a surface of the second heat radiation plate 105B facing away from the fixing belt 101.

The first heat radiation plate 105A is swingably pivoted through a first pivot part 107A at the end opposite from the power supply shutoff member 104, and the second heat radiation plate 105B is swingably pivoted through a second pivot part 107B at the end opposite from the power supply shutoff member 104. The first pivot part 107A pivotably supports the first heat radiation plate 105A in a direction toward or away from the fixing belt 101. Likewise, the second pivot part 107B pivotably supports the second heat radiation plate 105B in a direction toward or away from the fixing belt 101.

The first heat radiation plate 105A and the second heat radiation plate 105B are restricted by a restrictor, not shown, from movement toward the fixing belt 101 (inner side) so as to avoid contact with the fixing belt 101 before thermal expansion. The restrictor may include a stopper or the like that comes in contact with the first heat radiation plate 105A and the second heat radiation plate 105B to restrict movements of the first heat radiation plate 105A and the second heat radiation plate 105B. The distance of the first heat radiation plate 105A and the second heat radiation plate 105B from the fixing belt 101 before thermal expansion is similar to the distance described with reference to FIGS. 1 to 5.

The elastic member 106 pushes the power supply shutoff member 104 by an elastic force toward the fixing belt 101. Therefore, when the fixing belt 101 thermally expands to push open at least one of the first heat radiation plate 105A and the second heat radiation plate 105B, the power supply shutoff member 104 is pressed against the fixing belt 101 by the elastic force of the elastic member 106. The pushing by the elastic force may be called urging. The elastic member 106 may be disposed at any position relative to the power supply shutoff member 104 that can push the power supply shutoff member 104 toward the side of the fixing belt 101. In some examples, the elastic member 106 may be disposed on a side of the power supply shutoff member 104 opposite from the fixing belt 101, to more easily pushing the power supply shutoff member 104 toward the side of the fixing belt 101 by the elastic member 106. Also, the elastic member 106 may be any suitable member that has resilient elasticity. In some examples, the elastic member 106 includes a spring (coil spring) for improved manufacturability. In the example fixing device 50A, the elastic member 106 includes a spring disposed on the side of the power supply shutoff member 104 opposite from the fixing belt 101.

With reference to FIG. 23, before the fixing belt 101 thermally expands, the first heat radiation plate 105A and the second heat radiation plate 105B are restricted by the restrictor from moving toward the side of the fixing belt 101. The power supply shutoff member 104 is pushed by the elastic member 106 toward the side of the fixing belt 101 and latched by the first heat radiation plate 105A and the second heat radiation plate 105B from the side of the fixing belt 101.

Figure 25:
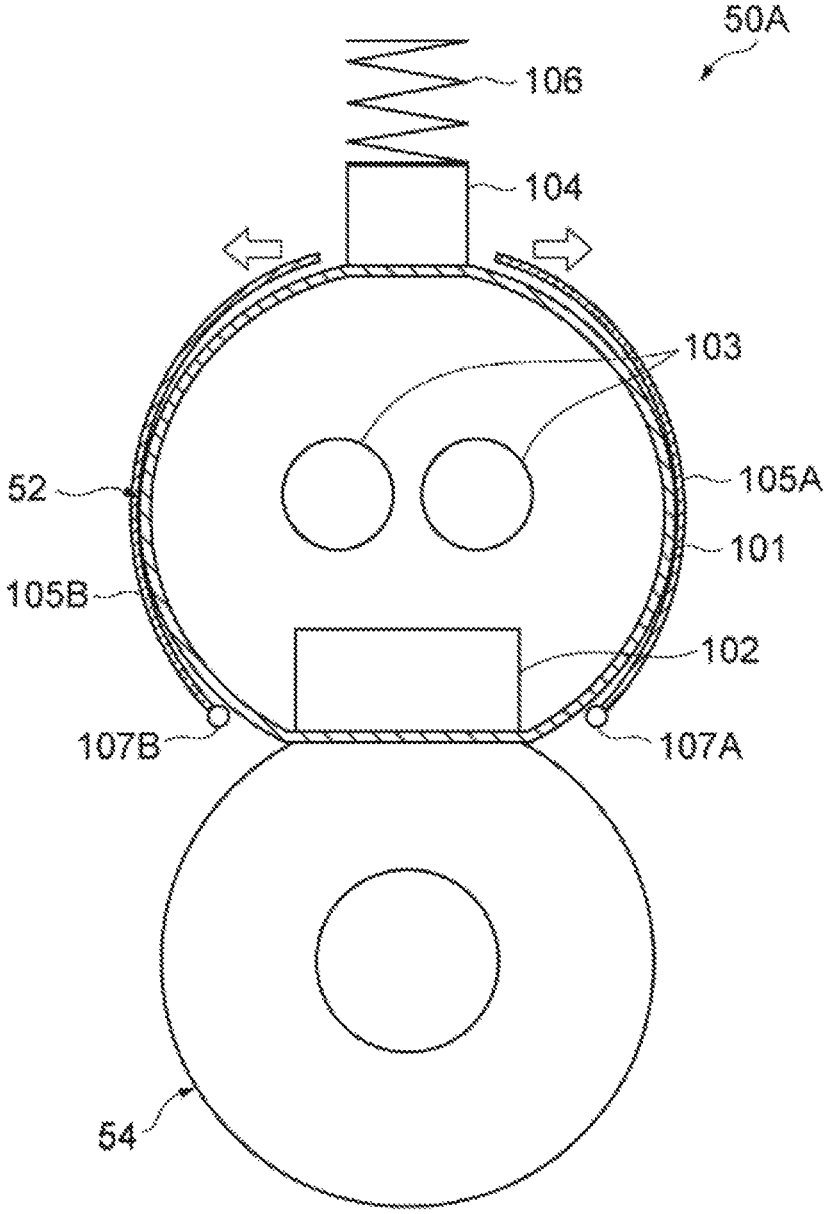
FIG. 25 is a schematic cross-sectional view of the example fixing device in a state in which the fixing belt has thermally expanded.

With reference to FIG. 25, upon unusual heating of the fixing belt 101, the fixing belt 101 thermally expands to come in contact with the first heat radiation plate 105A and the second heat radiation plate 105B. Heat is then dissipated from the fixing belt 101 to the first heat radiation plate 105A and the second heat radiation plate 105B, and the temperature increase rate of the fixing belt 101 is made slower. Accordingly, in some examples, the length, elastic coefficient and the like of the elastic member 106 are set such that the fixing belt 101 is not depressed by the elastic force of the elastic member 106. Even if the fixing belt 101 depresses due to the elastic force of the elastic member 106, the movement toward the side of the fixing belt 101 is ceased when the elastic member 106 has fully extended.

When the fixing belt 101 is thermally expanded further, the first heat radiation plate 105A and the second heat radiation plate 105B are pushed by the fixing belt 101 and swing about the first pivot part 107A and the second pivot part 107B. The distance between the first heat radiation plate 105A and the second heat radiation plate 105B is thereby enlarged, and the latching of the power supply shutoff member 104 by the first heat radiation plate 105A and the second heat radiation plate 105B is released. Then, the power supply shutoff member 104 is pushed against the thermally expanded fixing belt 101 by the elastic force (urging force) of the elastic member 106. The power supply shutoff member 104 is thereby maintained in a contact state with the fixing belt 101.

Figure 26:
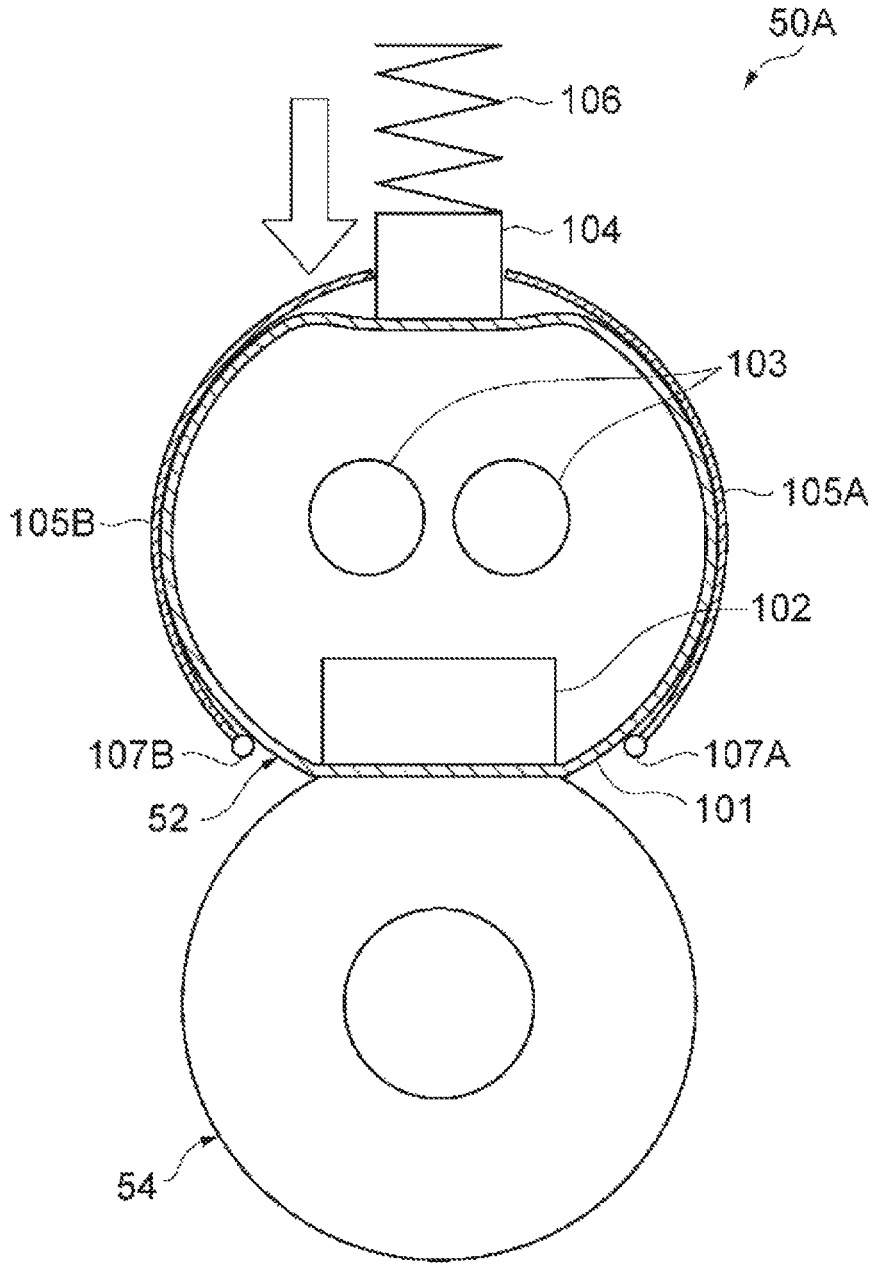
FIG. 26 is a schematic cross-sectional view of the example fixing device in a state in which the fixing belt has contracted.

With reference to FIG. 26, even if the fixing belt 101 contracts, the power supply shutoff member 104 is pushed against the fixing belt 101 by the elastic force of the elastic member 106, and the power supply shutoff member 104 is thereby maintained in a contact state with the fixing belt 101.

Accordingly, as the first heat radiation plate 105A and the second heat radiation plate 105B are divided in the peripheral direction of the fixing belt 101 and disposed to contact with or separate from each other, when the fixing belt 101 thermally expands to push the first heat radiation plate 105A and the second heat radiation plate 105B, the first heat radiation plate 105A and the second heat radiation plate 105B are made to open in the peripheral direction of the fixing belt 101. Then, the latching by the first heat radiation plate 105A and the second heat radiation plate 105B is released and the power supply shutoff member 104 is pushed against the fixing belt 101 by the elastic member 106. With this, the power supply shutoff member 104 can more reliably contact the fixing belt 101 and the contact state can be maintained to better operate the power supply shutoff member 104.

Since the elastic member 106 is a spring, the power supply shutoff member 104 can be better pressed against the fixing belt 101. Also, when the elongation amount of the spring is adjusted, the power supply shutoff member 104 can be suppressed from being excessively pressed against the fixing belt 101.

Figure 27:
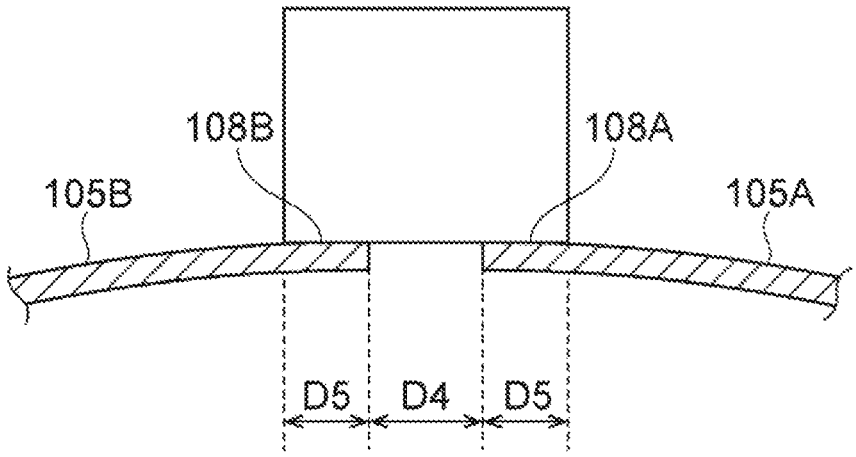
FIG. 27 is a diagram illustrating relative positions of the power supply shutoff member, the first heat radiation plate and the second heat radiation plate in the example fixing device.

With reference to FIG. 27, the distance D4 between the first heat radiation plate 105A and the second heat radiation plate 105B in the peripheral direction of the fixing belt 101 is not particularly limited. The distance D4 is 0 mm or more in some example, or 1 mm or more in other examples, to provide more reliable latching of the power supply shutoff member 104 by the first heat radiation plate 105A and the second heat radiation plate 105B prior to the thermal expansion of the fixing belt 101. The distance D4 is 0 mm means that the first heat radiation plate 105A is in abutment with the second heat radiation plate 105B, in the peripheral direction of the fixing belt 101. The distance D4 may be 3 mm or less in some examples, or 2 mm or less in other examples, to more reliably press the power supply shutoff member 104 against the fixing belt 101 through the spacing between the first heat radiation plate 105A and the second heat radiation plate 105B when the fixing belt 101 has thermally expanded. For example, the distance D4 may be 0 mm or more and 3 mm or less in some examples, or 1 mm or more and 2 mm or less in other examples.

A latch width D5, in the peripheral direction of the fixing belt 101, for latching the power supply shutoff member 104 by the first heat radiation plate 105A and the second heat radiation plate 105B is not particularly limited. The latch width D5 may be 0.1 mm or more in some examples, or 0.2 mm or more in other examples, to more reliably latch the power supply shutoff member 104. The latch width may be 1 mm or less in some examples, or 0.5 mm or less in some examples, for releasing the latching of the power supply shutoff member 104 by the first heat radiation plate 105A and the second heat radiation plate 105B and pressing the power supply shutoff member 104 against the fixing belt 101 as soon as the fixing belt 101 has thermally expanded to push open the first heat radiation plate 105A and the second heat radiation plate 105B. Specifically, the latch width D5 may be 0.1 mm or more and 1 mm or less in some examples, or 0.2 mm or more and 0.5 mm or less in other examples.

The static friction coefficient μ, relative to the power supply shutoff member 104, of the latching surfaces 108A and 108B that latch the power supply shutoff member 104 is not particularly limited. The static friction coefficient μ may be 0.1 or more in some examples, or 0.2 or more in other examples, for improved manufacturability of the first heat radiation plate 105A and the second heat radiation plate 105B. The static friction coefficient μ may be 1.0 or less in some examples, or 0.4 or less in other examples, for releasing the latching of the power supply shutoff member 104 by the first heat radiation plate 105A and the second heat radiation plate 105B and pressing the power supply shutoff member 104 against the fixing belt 101 as soon as the fixing belt 101 has thermally expanded to push open the first heat radiation plate 105A and the second heat radiation plate 105B. For examples, the static friction coefficient μ may be 0.1 or more and 1.0 or less in some examples, or 0.2 or more and 0.4 or less in other examples.

The static friction coefficient μ of the latching surfaces 108A and 108B can be decreased by providing the latching surfaces 108A and 108B with a coating, mirror surface or the like. In such case, the latching surfaces 108A may be provided with a coating of a fluororesin or the like, to more easily decrease the static friction coefficient μ.

In the example fixing device 50A, as the power supply shutoff member 104 is merely latched by the first heat radiation plate 105A and the second heat radiation plate 105B, dislodging from the first heat radiation plate 105A and the second heat radiation plate 105B may occur due to vibrations. In view of this, the first heat radiation plate 105A and the second heat radiation plate 105B may be arranged as shown in FIG. 28.

Figure 28:
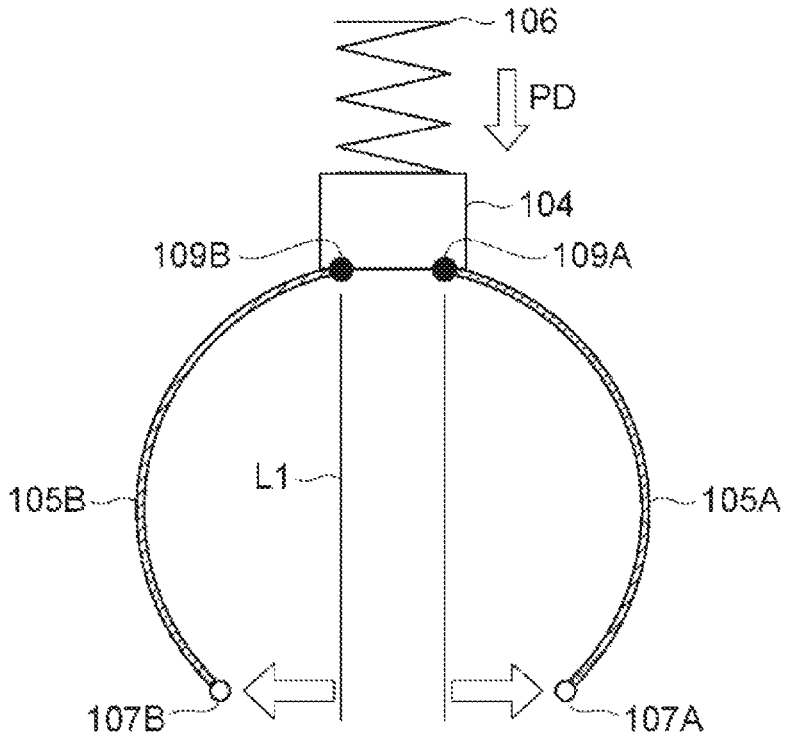
FIG. 28 is a diagram illustrating an arrangement of the first heat radiation plate and the second heat radiation plate in the example fixing device.
Figure 29:
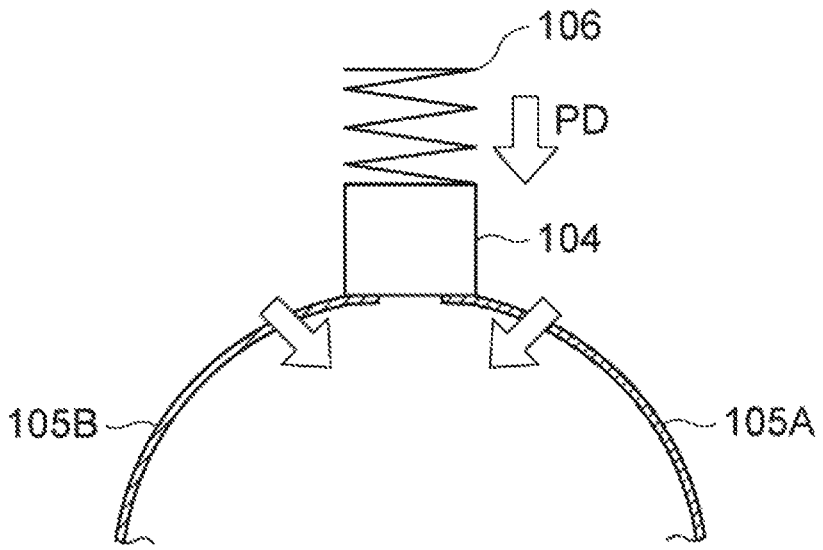
FIG. 29 is a diagram illustrating a direction of force in the example of FIG. 28.

With reference to FIG. 28, a direction in which the elastic member 106 pushes the power supply shutoff member 104 may be defined as a push direction PD. A position at which the first heat radiation plate 105A latches the power supply shutoff member 104 may be defined as a first latch position 109A, and a line that is parallel with the push direction PD and extends through the first latch position 109A may be defined as a first reference line L1. A position at which the second heat radiation plate 105B latches the power supply shutoff member 104 may be defined as a second latch position 109B, and a line that is parallel with the push direction PD and extends through the second latch position 109B may be defined as a second reference line L2. The first pivot part 107A is situated outward of the first reference line L1 and the second pivot part 107B is situated outward of the second reference line L2. For example, the first latch position 109A and the second latch position 1096 are situated inward of the first pivot part 107A and the second pivot part 107B in the direction along which the first heat radiation plate 105A and the second heat radiation plate 105B are made to open and close. Accordingly, the elastic force acting in the push direction PD by the elastic member 106 is converted to a directional force to close the first heat radiation plate 105A and the second heat radiation plate 105B, as shown in FIG. 29. This suppresses the first heat radiation plate 105A and the second heat radiation plate 105B from opening before the fixing belt 101 has thermally expanded.

Figure 30:
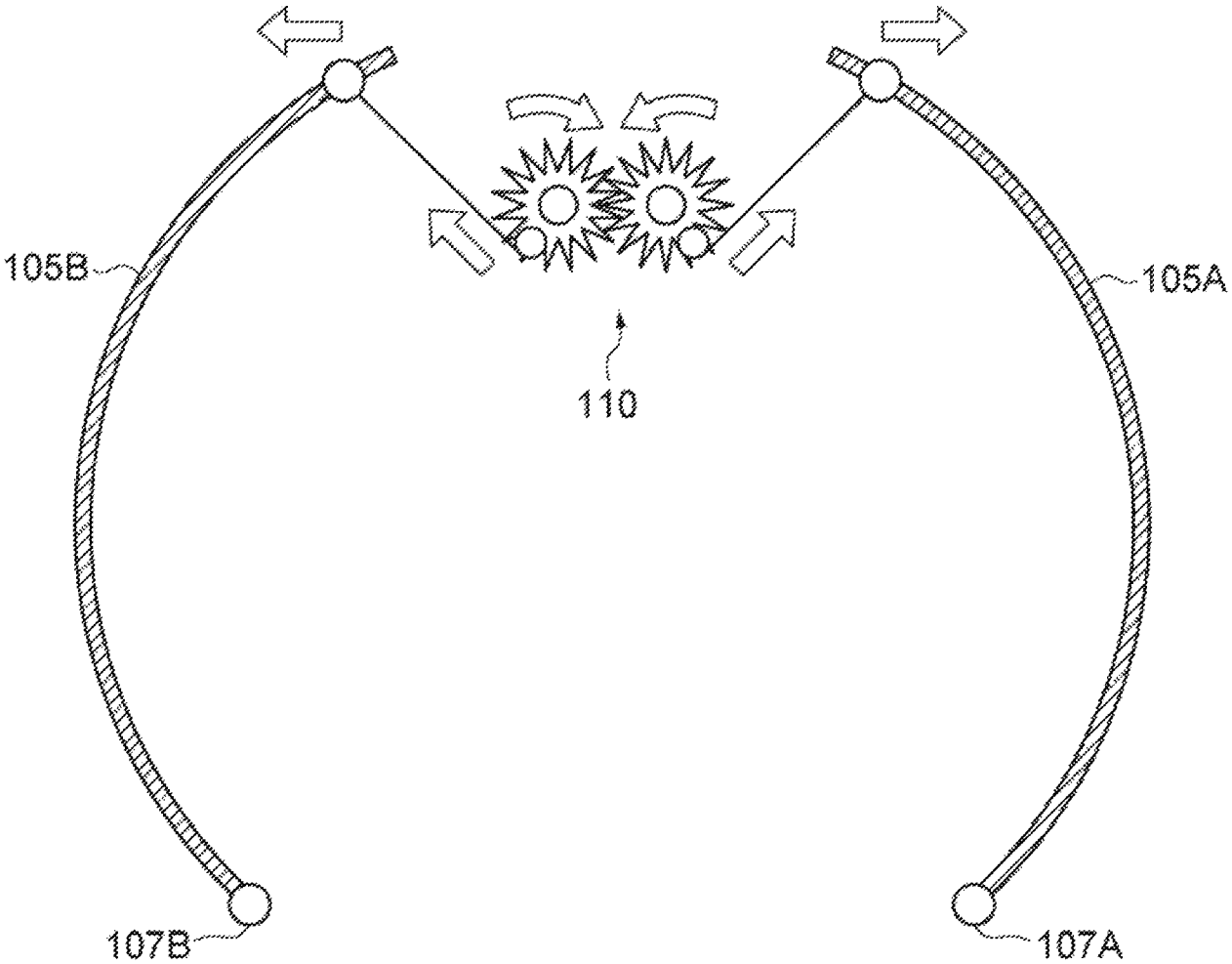
FIG. 30 is a schematic cross-sectional view showing a first heat radiation plate and a second heat radiation plate in an example fixing device.

With reference to FIG. 30, the first heat radiation plate 105A and the second heat radiation plate 105B are coupled through a linkage mechanism 110 that associates the swing movements with each other.

The linkage mechanism 110 is not particularly limited and may be constituted, for example, by a couple of gears, and a couple of rods that mesh with the respective gears and connected to the first heat radiation plate 105A and the second heat radiation plate 105B.

As the first heat radiation plate 105A and the second heat radiation plate 105B are coupled through the linkage mechanism 110 that associates the swing movements with each other, both of the first heat radiation plate 105A and the second heat radiation plate 105B can be made to open at the same time when the fixing belt 101 has thermally expanded. With this, the latching of the power supply shutoff member 104 can be prevented from releasing when only one of the first heat radiation plate 105A and the second heat radiation plate 105B has opened.

Figure 31:
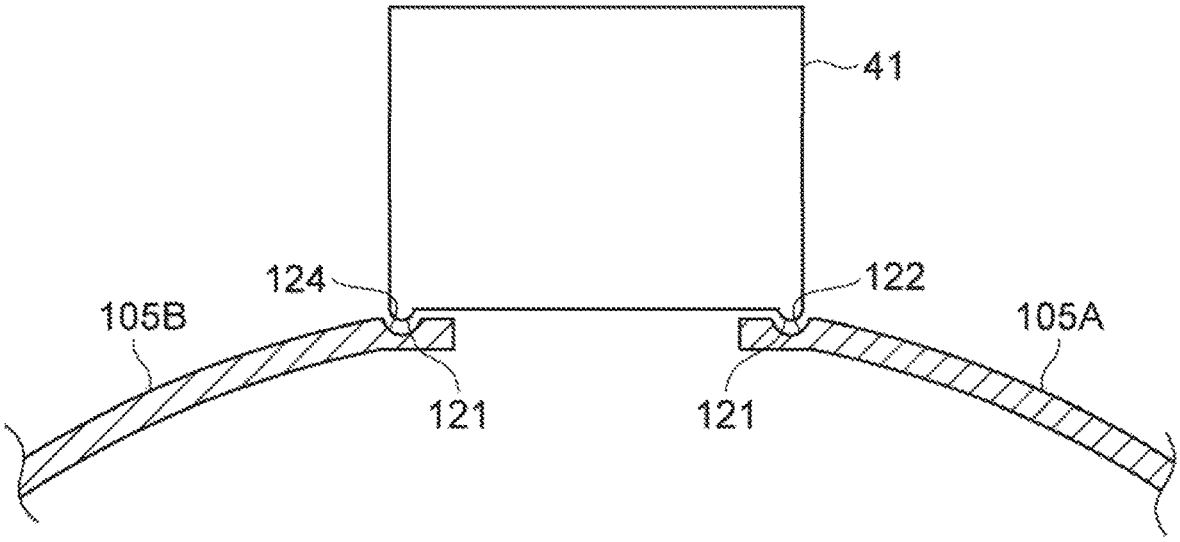
FIG. 31 is a schematic cross-sectional view showing a first heat radiation plate and a second heat radiation plate in an example fixing device.

With reference to FIG. 31, an example fixing device includes mutually engageable projection and recess formed in the power supply shutoff member 104, the first heat radiation plate 105A and the second heat radiation plate 105B.

In the example fixing device, the power supply shutoff member 104 is provided with a first projection 121 that projects toward the first heat radiation plate 105A, and the first heat radiation plate 105A is provided with a first recess 122 into which the first projection 121 is inserted. Further, the power supply shutoff member 104 is provided with a second projection 123 that projects toward the second heat radiation plate 105B, and the second heat radiation plate 105B is provided with a second recess 124 into which the second projection 123 is inserted.

The first projection 121 and the second projection 123 project in a direction that is orthogonal to the direction along which the first heat radiation plate 105A and the second heat radiation plate 105B are made to open and close. Therefore, when the first projection 121 is inserted into the first recess 122, the first heat radiation plate 105A is temporarily prevented from opening. When the first projection 121 is removed from the first recess 122, the first heat radiation plate 105A can be opened. When the second projection 123 is inserted into the second recess 124, the second heat radiation plate 105B is temporarily prevented from opening. When the second projection 123 is removed from the second recess 124, the second heat radiation plate 105B can be opened.

When the first projection 121 and the second projection 123 are inserted into the first recess 122 and the second recess 124, the first heat radiation plate 105A and the second heat radiation plate 105B can be suppressed from opening easily relative to the power supply shutoff member 104. This enables to suppress the first heat radiation plate 105A and the second heat radiation plate 105B from opening before the fixing belt 101 has thermally expanded.

The first projection and the first recess may be provided to either of the first heat radiation plate 105A and the power supply shutoff member 104, and the second projection and the second recess may be provided to either of the second heat radiation plate 105B and the power supply shutoff member 104. For example, one of the first heat radiation plate 105A and the power supply shutoff member 104 may be provided with the first projection that project toward the other of the first heat radiation plate 105A and the power supply shutoff member 104, and the other of the first heat radiation plate 105A and the power supply shutoff member 104 may be provided with the first recess into which the first projection is inserted. Also, one of the second heat radiation plate 105B and the power supply shutoff member 104 may be provided with the second projection that projects toward the other of the second heat radiation plate 105B and the power supply shutoff member 104, and the other of the second heat radiation plate 105B and the power supply shutoff member 104 may be provided with the second recess into which the second projection is inserted.

Figure 32:
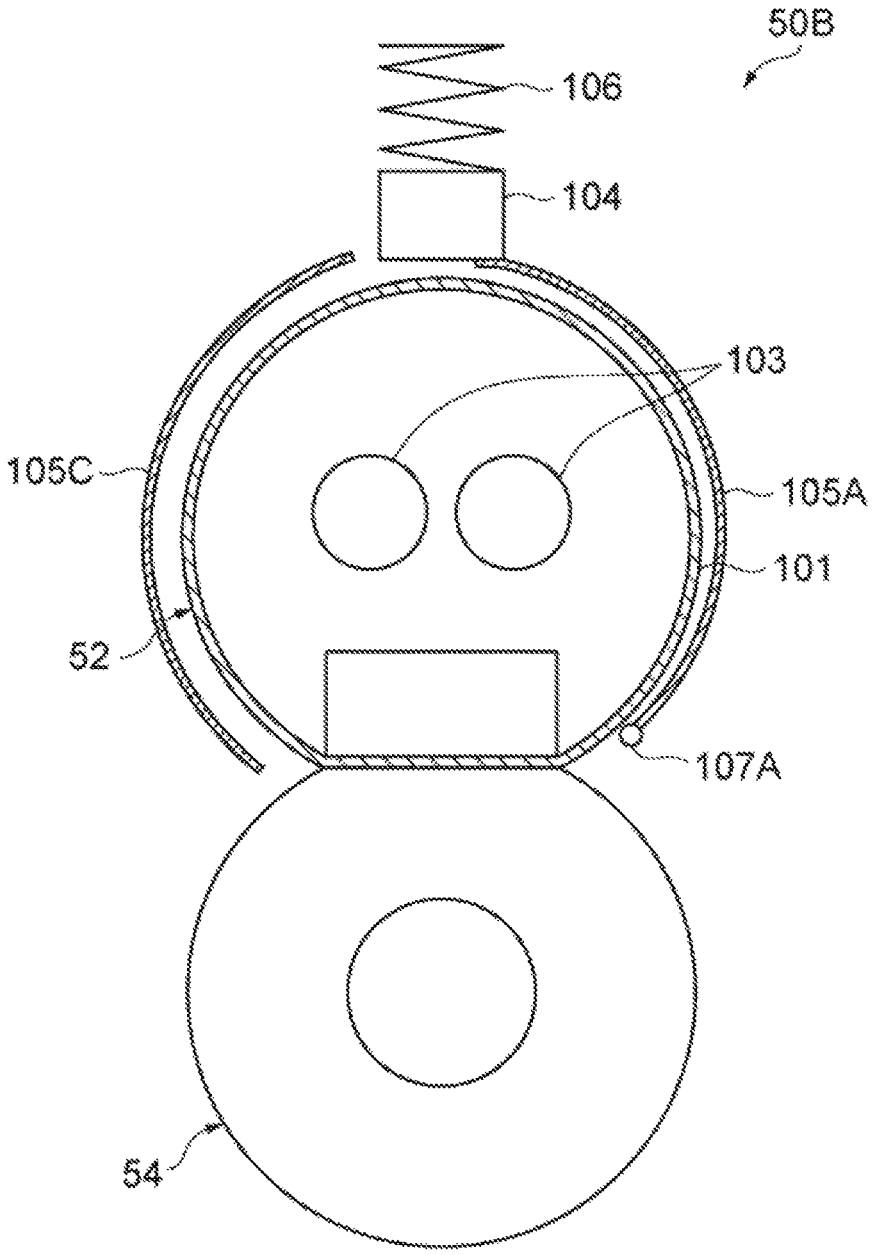
FIG. 32 is a schematic cross-sectional view of an example fixing device.
Figure 33:
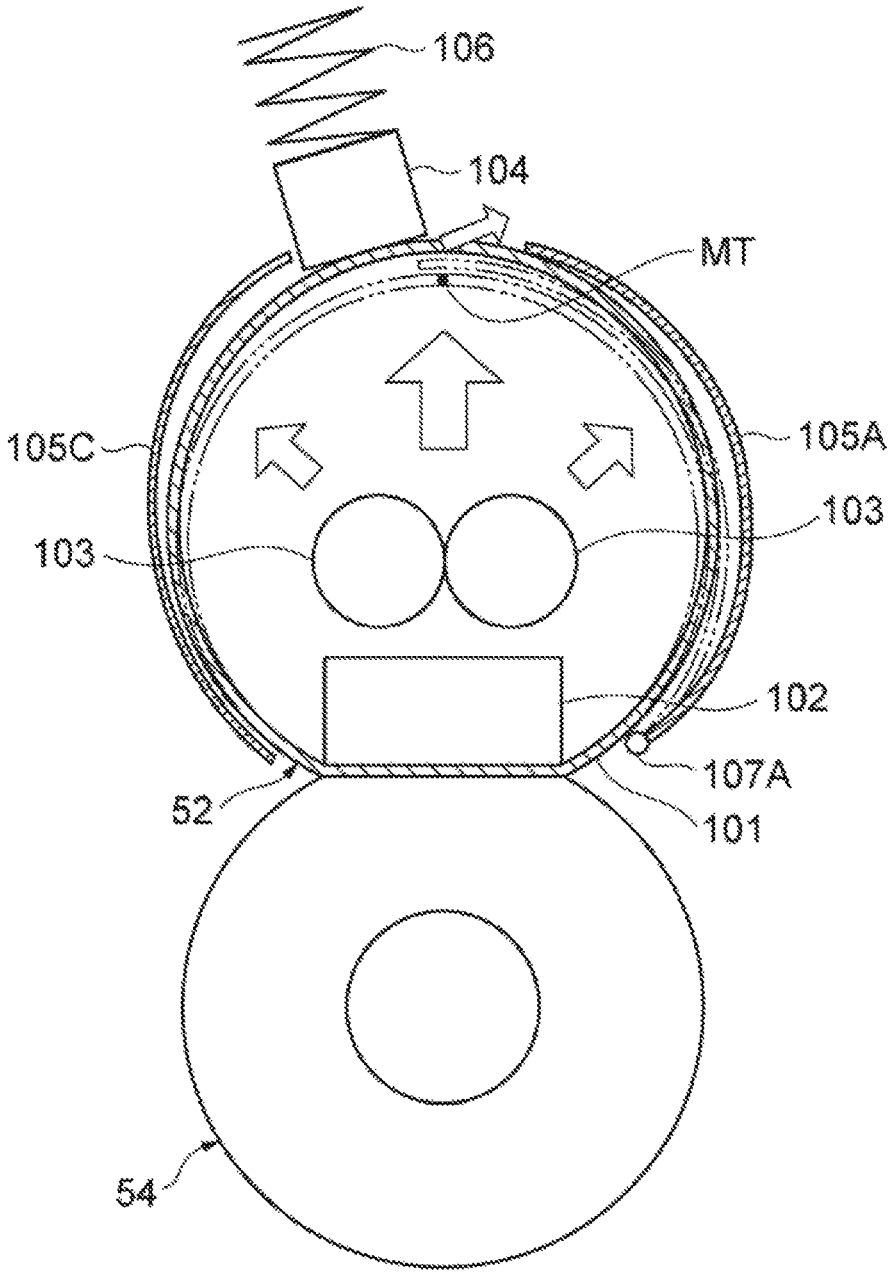
FIG. 33 is a schematic cross-sectional view showing an example fixing device.

With reference to FIG. 32, in an example fixing device 50B, the second heat radiation plate is fixed.

The example fixing device 50B includes the fixing belt 101, the heater roller 52 having the pusher member 102 and the heat source 103, the pressure roller 54, the power supply shutoff member 104, the heat radiation plate 105 having the first heat radiation plate 105A and a second heat radiation plate 105C, and the elastic member 106.

The second heat radiation plate 105C is unswingably fixed. For example, the second heat radiation plate 105C may be directly or indirectly fixed to a frame (not shown) of the image forming apparatus. The second heat radiation plate 105C does not latch the power supply shutoff member 104 from the side of the fixing belt 101. The first heat radiation plate 105A latches the power supply shutoff member 104 from the side of the fixing belt 101 as in the case of the first heat radiation plate 105A illustrated in FIG. 22 to FIG. 29, and is pivotable via the first pivot part 107A at the other end opposite from the power supply shutoff member 104. For example, the power supply shutoff member 104 is latched by the first heat radiation plate 105A from the side of the fixing belt 101, but is not latched by the second heat radiation plate 105C from the side of the fixing belt 101.

As the second heat radiation plate 105C is fixed (e.g., not swingable or pivotable) and the power supply shutoff member 104 is latched only by the first heat radiation plate 105A, the first heat radiation plate 105A is pushed open to unfailingly release the latching of the power supply shutoff member 104 when the fixing belt 101 thermally expands. This enables to reliably press the power supply shutoff member 104 against the fixing belt 101 when the fixing belt 101 has thermally expanded.

As the power supply shutoff member 104 is merely latched by the first heat radiation plate 105A, dislodging from the first heat radiation plate 105A may occur due to vibrations. In view of this, the first pivot part 107A may be situated outward of the first reference line L1, similarly to the example illustrated in FIG. 28. For example, the first latch position 109A is situated inward of the first pivot part 107A, in the direction along which the first heat radiation plate 105A is made to open and close. The elastic force acting in the push direction PD by the elastic member 106 is thereby converted to a directional force to close the first heat radiation plate 105A (see FIG. 29), and the first heat radiation plate 105A can be suppressed from opening before the fixing belt 101 has thermally expanded.

Further, mutually engageable projection and recess may be formed in the power supply shutoff member 104 and the first heat radiation plate 105A (see FIG. 31). For example, one of the first heat radiation plate 105A and the power supply shutoff member 104 may be provided with a first projection that projects toward the other of the first heat radiation plate 105A and the power supply shutoff member 104. The other of the first heat radiation plate 105A and the power supply shutoff member 104 may be provided with a first recess into which the first projection is inserted.

The fixing belt 101 is likely to thermally expand most, and likely to contract most at a position at which the temperature caused by heating from the heat source 103 is maximum. In the example of FIG. 22 to FIG. 29, as only the first heat radiation plate 105A is swingable, the operation of the power supply shutoff member 104 may be delayed if the first heat radiation plate 105A is not disposed in such position.

A position of the fixing belt 101 at which the temperature caused by heating from the heat source 103 is maximum may be defined as a maximum temperature position MT. The maximum temperature position MT may be similar to the maximum temperature position MT described with reference to the example illustrated in FIGS. 1 to 5. Then, the first heat radiation plate 105A may be made to cover the maximum temperature position MT.

When the first heat radiation plate 105A covers the maximum temperature position MT, the first heat radiation plate 105A can follow the thermal expansion of the fixing belt 101 earlier and the power supply shutoff member 104 can be pressed against the fixing belt 101 earlier, thereby suppressing a delay in the operation of the power supply shutoff member 104.

Figure 34A:
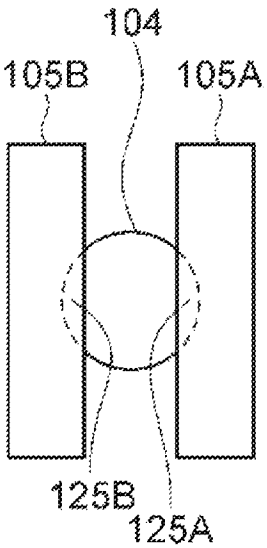
FIG. 34(*a*), FIG. 34(*b*) and FIG. 34(*c*) are diagrams illustrating example structures for latching a power supply shutoff member by a first heat radiation plate and a second heat radiation plate.
Figure 34B:
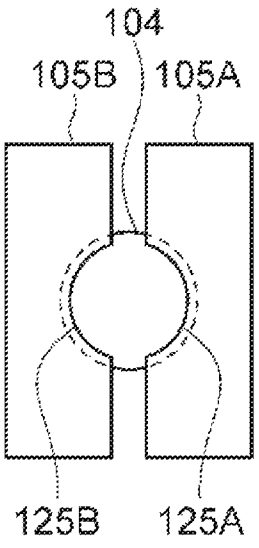
Figure 34C:
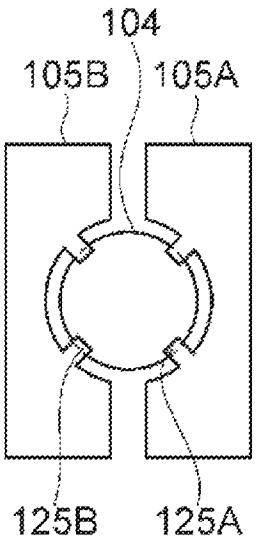

In other examples, a latching portion 125A and a latching portion 125B of the first heat radiation plate 105A and the second heat radiation plate 105B for latching the power supply shutoff member 104 may vary in shape, size, position and/or the like. For example, the latching portion 125A and the latching portion 125B may have shapes that are parallel (e.g., mutually opposed in parallel) as shown in FIG. 34(*a*), may have semi-arcuate shapes along the perimeter of the power supply shutoff member 104 as shown in FIG. 34(*b*), or may include one or more elongated projections as shown in FIG. 34(*c*).

In some examples, the latching portion 125A and the latching portion 125B may be symmetrical.

A latching structure of the power supply shutoff member 104 relative to the first heat radiation plate 105A and the second heat radiation plate 105B is not particularly limited.

Figure 35A:
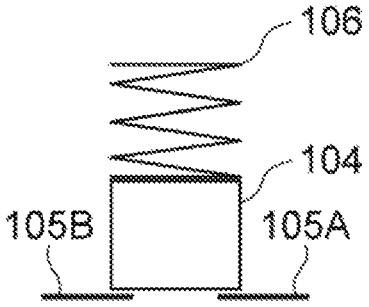
FIG. 35(*a*) and FIG. 35(*b*) are diagrams illustrating example structures for latching a power supply shutoff member by a first heat radiation plate and a second heat radiation plate.
Figure 35B:
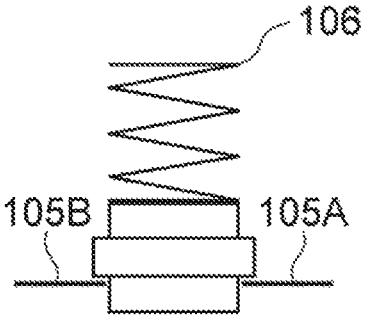

For example, the first heat radiation plate 105A and the second heat radiation plate 105B may latch the bottom surface (surface on the side of the fixing belt) of the power supply shutoff member 104 as shown in FIG. 35(*a*), or may latch a ridge projected from a lateral surface of the power supply shutoff member 104.

Figure 36:
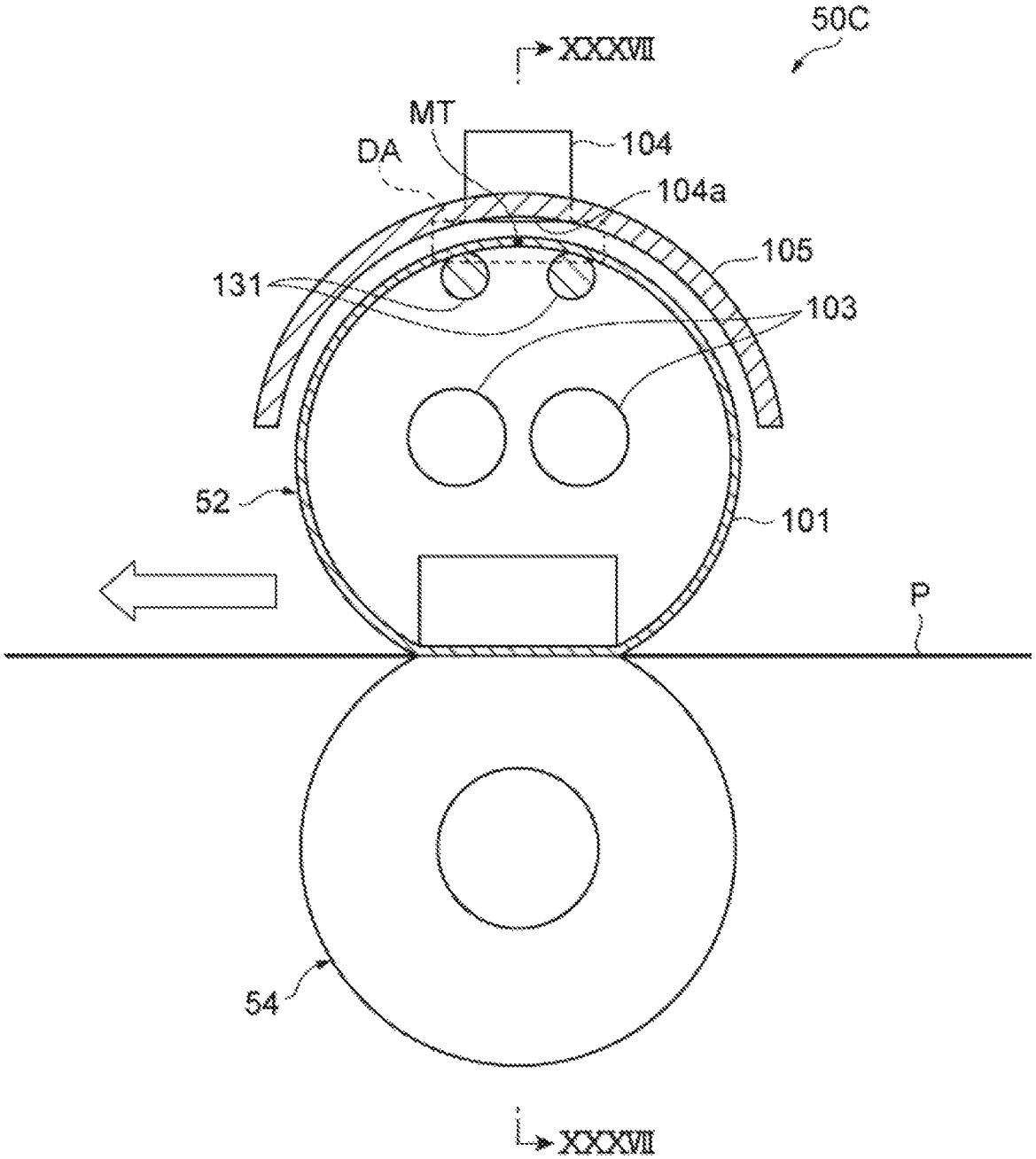
FIG. 36 is a schematic cross-sectional view of an example fixing device.
Figure 37:
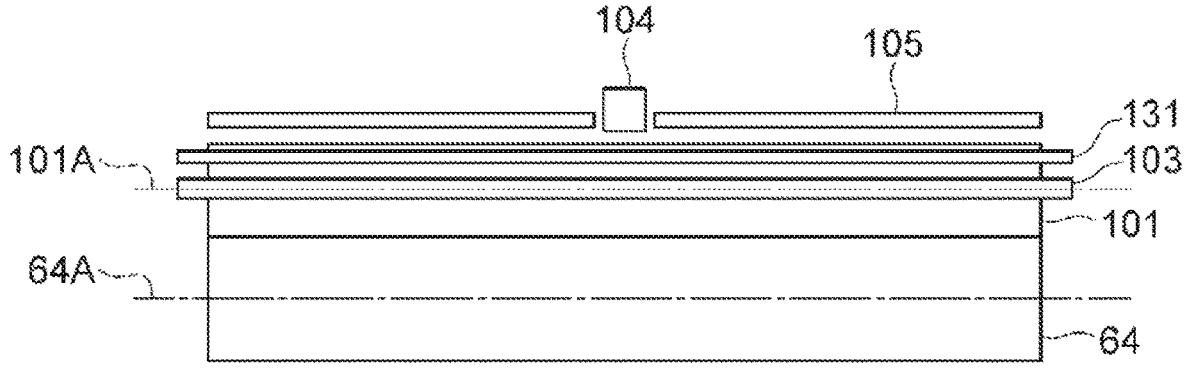
FIG. 37 is a schematic cross-sectional view of the example fixing device illustrated in FIG. 36, taken along line XXXVII-XXXVII.

With reference to FIG. 36 and FIG. 37, an example fixing device 50C may include a deformation suppression member in an inner peripheral side of the fixing belt. [0195] The example fixing device 50C includes the fixing belt 101, the heater roller 52 having the pusher member 102 and the heat source 103, the pressure roller 54, the power supply shutoff member 104, the heat radiation plate 105, and a deformation suppression member 131.

The power supply shutoff member 104 may shut off the supply of power to the heat source 103 based on the temperature of the fixing belt 101. For example, the thermostat described with reference to the example illustrated in FIGS. 2 to 5 may be used as the power supply shutoff member 104.

A position of the fixing belt 101 at which the temperature caused by heating from the heat source 103 is maximum is defined as a maximum temperature position MT. The maximum temperature position MT may be similar the maximum temperature position MT described with reference to FIGS. 1 to 5. Also, an area of the power supply shutoff member 104 to detect the temperature of the fixing belt 101 is defined as a detection area DA. The power supply shutoff member 104 may be disposed such that the maximum temperature position MT is included in the detection area DA.

Figure 38:
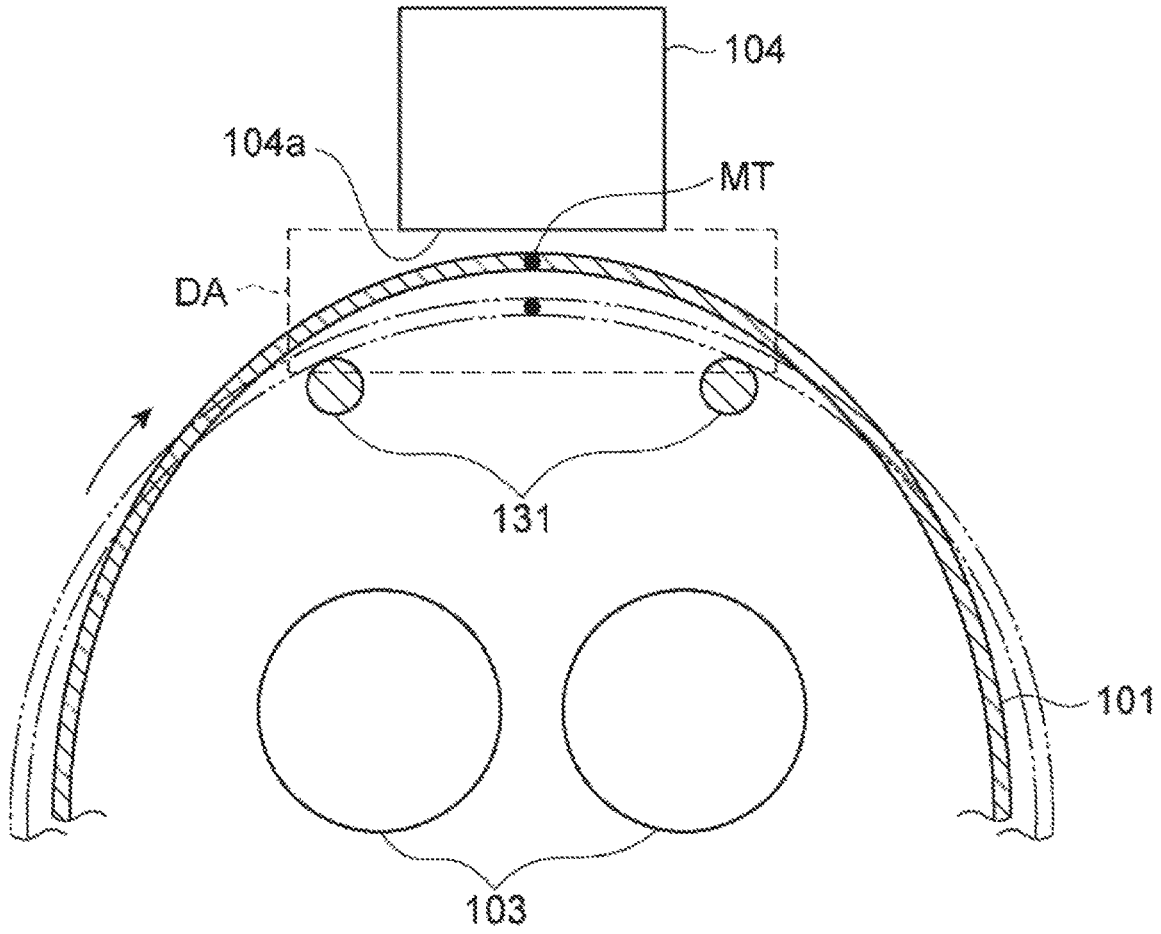
FIG. 38 is a diagram illustrating relative positions of a power supply shutoff member, a fixing belt and a deformation suppression member in an example fixing device, when the fixing belt is stationary or rotated.
Figure 39:
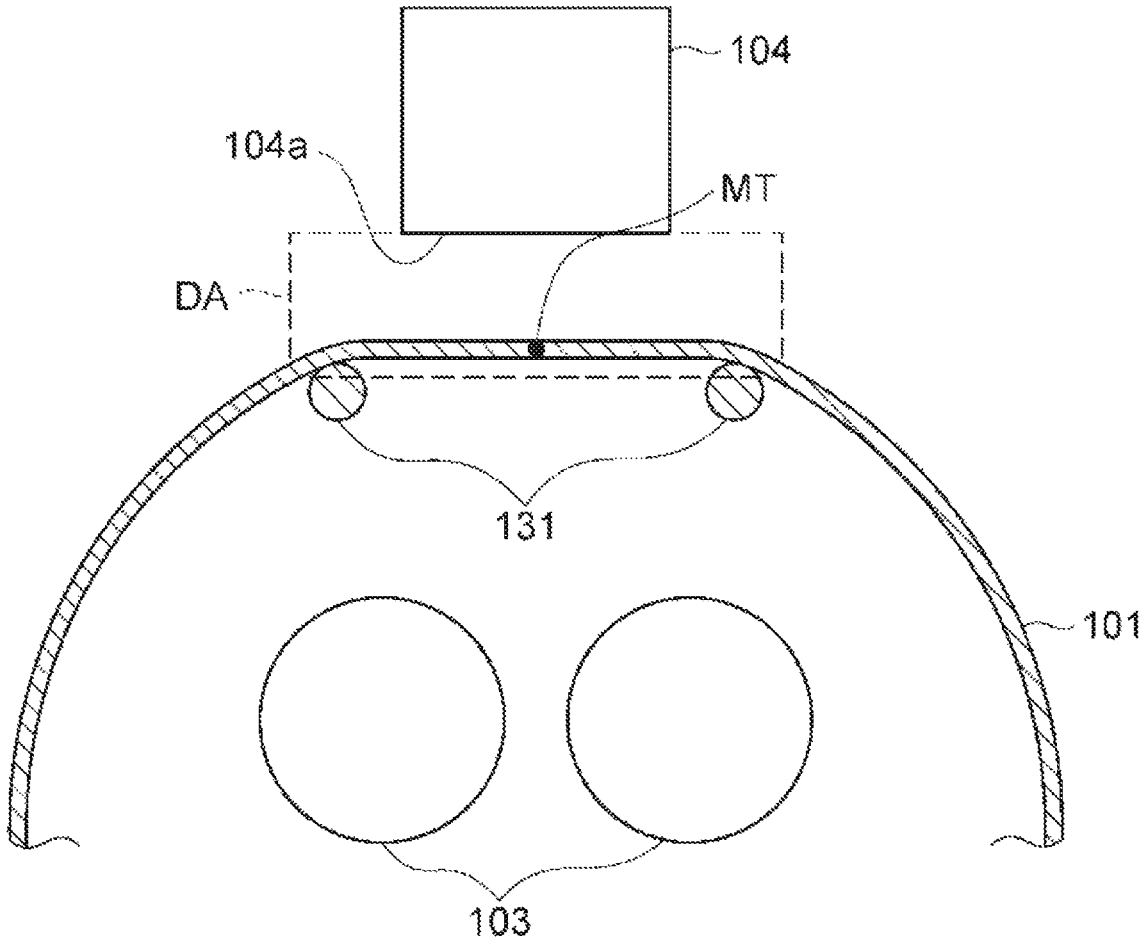
FIG. 39 is a diagram illustrating relative positions of a power supply shutoff member, a fixing belt and a deformation suppression member in the example fixing device, when the fixing belt contracts.

The detection area DA of the power supply shutoff member 104 may vary depending on the power supply shutoff member 104 used, but it may lie, for example, in the region described as follows. As shown in FIG. 36, FIG. 38 and FIG. 39, on the side of the fixing belt 101, a surface of the power supply shutoff member 104 is defined as a detection surface 104*a* to detect the temperature of the fixing belt 101. As mentioned above, the detection surface 104*a* is a surface of the power supply shutoff member 104 to contact the thermally expanded fixing belt 101. Then, the detection area DA may be a region within 5 mm from the detection surface 104*a* on the side of the fixing belt 101 and within ±10 mm from the center of the detection surface 104*a* in the peripheral direction of the fixing belt 101.

The deformation suppression member 131 is a member disposed on an inner peripheral side of the fixing belt 101 to suppress the fixing belt 101 from deforming toward the inner peripheral side. At least one deformation suppression member 131 may be provided in the inner peripheral side of the fixing belt 101. In the example illustrated in FIG. 36, two deformation suppression members 131 are provided in the inner peripheral side of the fixing belt 101.

The fixing belt 101 may rotate to follow the pressure roller 54. When the fixing belt 101 is in a state of operation, a rotary downstream side of the fixing belt 101 relative to the fixing nip part R3 deforms from a stationary position in a direction that deviates from the rotation axis 101A of the fixing belt 101, and a rotary upstream side of the fixing belt 101 relative to the fixing nip part R3 deforms from a stationary position in a direction that approaches the rotation axis 101A of the fixing belt 101.

Accordingly, as shown in FIG. 38, the deformation suppression members 131 may be disposed in a position to contact the fixing belt 101 but to avoid contact with the fixing belt 101 during rotation of the fixing belt 101. In FIG. 38, the fixing belt 101 represented in dotted lines indicates a stationary state and the fixing belt 101 represented in solid lines indicates a normal operation state in which the normal rotation is made.

The deformation suppression members 131 are disposed in a position at which it does not obstruct heating of the fixing belt 101 from the heat source 103 and the maximum temperature position MT is not placed outside the detection area DA. Accordingly, the deformation suppression members 131 are not disposed in the detection area DA.

With reference to FIG. 39, the deformation suppression members 131 may be disposed in a position at which, upon contraction of the fixing belt 101, they support the fixing belt 101 from an inner peripheral side of the fixing belt 101 to maintain the maximum temperature position MT in the detection area DA. When a plurality of the deformation suppression members 131 are provided, not all of the deformation suppression members 131 need to be disposed in the detection area DA, for example if the maximum temperature position MT is made to remain in the detection area DA upon contraction of the fixing belt 101. Such position of the deformation suppression members 131 may be determined through experiments, simulations or the like.

Then, as the deformation suppression members 131 come in contact with the fixing belt 101 when the fixing belt 101 contracts, the deformation suppression members 131 may be imparted with a function to dissipate heat from the fixing belt 101. Accordingly, the heat conductivity of the deformation suppression members 131 may be 5 W/mK or more and more in some examples, or 10 W/mK or more in other examples. The heat conductivity of the deformation suppression members 131 may be 5 W/mK or more and 600 W/mK or less in some examples, or 10 W/mK or more and 400 W/mK or less in other examples, in order to reduce cost.

Figure 40:
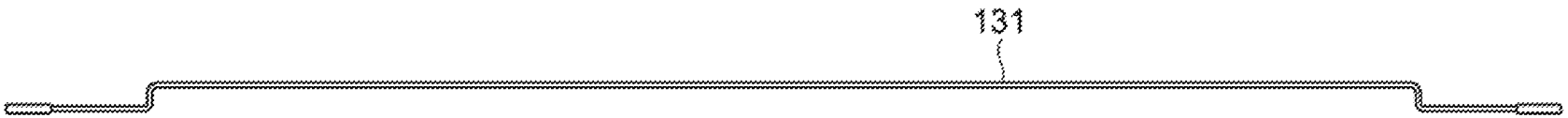
FIG. 40 is a front view of a rod-shaped deformation suppression member.

The shape, position, size and the like of the deformation suppression members are not particularly limited. For example, the shape of the deformation suppression member 131 can be rod-shaped. The cross-sectional shape of the deformation suppression member 131 is not particularly limited, and it may be circular in some examples. When the deformation suppression member 131 is a rod, the deformation suppression member 131 may extend in a direction parallel with the rotation axis 101A of the fixing belt 101 on an inner peripheral side of the fixing belt 101, so as to be juxtaposed with the heat source 103 as illustrated in FIG. 37 and FIG. 40. In a direction orthogonal to the rotation axis 101A of the fixing belt 101, the cross-sectional area of the deformation suppression member 131 may be 1.0 $mm^2$ or more in some examples, and 2.0 $mm^2$ or more in other example, to maintain a rigidity of the rod-shaped deformation suppression member 131. When a halogen lamp is used as the heat source 103, the cross-sectional area may be 30 $mm^2$ or less in some examples, or 20 $mm^2$ or less in some examples, to suppress the blocking of radiant heat from the heat source 103 by the deformation suppression member 131. For example, the cross-sectional area may be 1.0 $mm^2$ or more and 30 $mm^2$ or less in some examples, or 2.0 $mm^2$ or more and 20 $mm^2$ or less in other examples.

Figure 41:
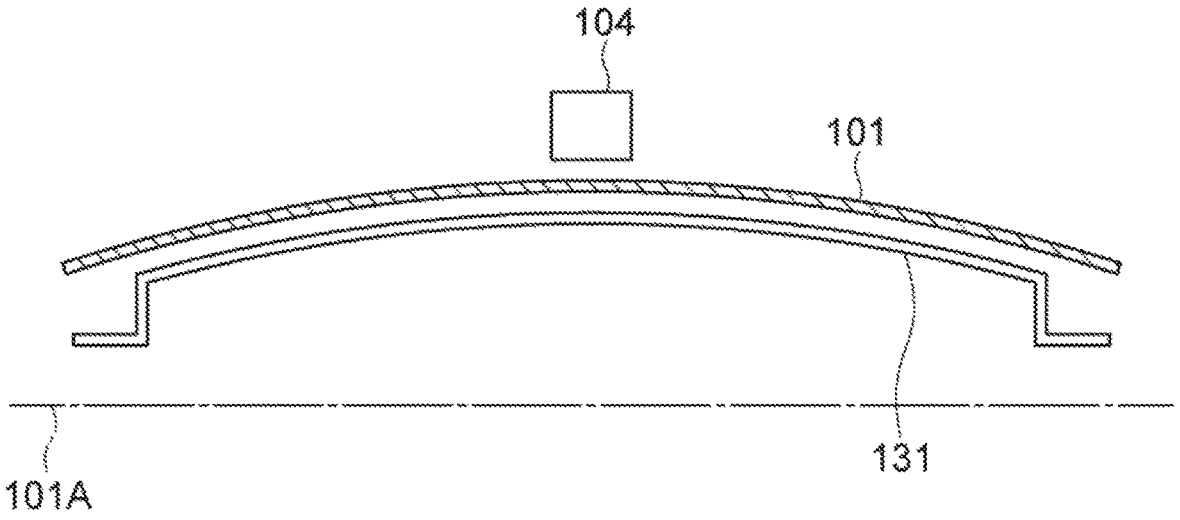
FIG. 41 is a diagram illustrating relative positions of a fixing belt and a deformation suppression member.

With reference to FIG. 41, during rotation, in the direction of the rotation axis 101A of the fixing belt 101, a central part of the fixing belt 101 may be curved to protrude relative to the edges. In such case, a central part of the deformation suppression member 131 may be curved to protrude relative to the ends in the direction of the rotation axis 101A of the fixing belt 101. Accordingly, the deformation suppression member 131 can conform with the fixing belt 101.

Figure 42:
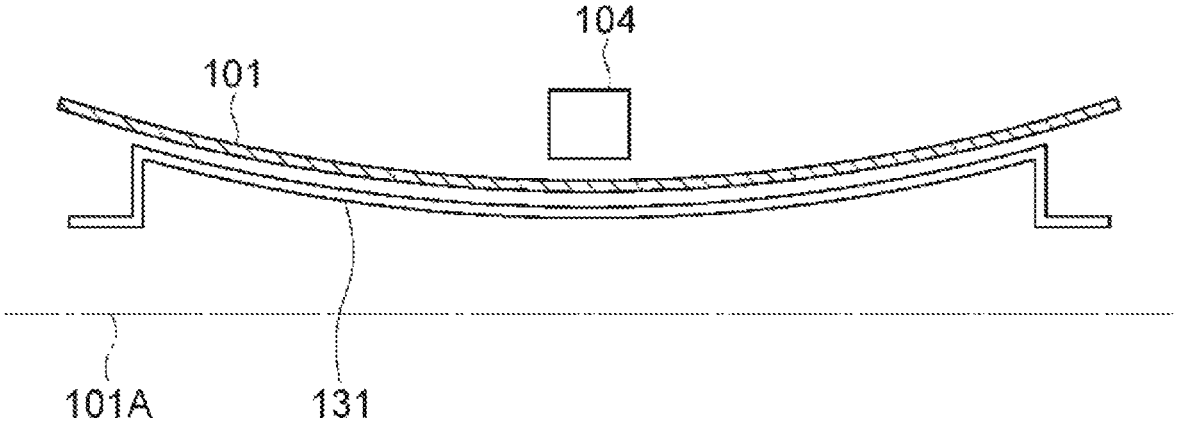
FIG. 42 is a diagram illustrating relative positions of a fixing belt and a deformation suppression member.

With reference to FIG. 42, during rotation, in the direction of the rotation axis 101A of the fixing belt 101, a central part of the fixing belt 101 may be curved to recess relative to the edges. In such case, a central part of the deformation suppression member 131 may be curved to recess relative to the ends in the direction of the rotation axis 101A of the fixing belt 101. Accordingly, the deformation suppression member 131 can conform with the fixing belt 101.

The shape of the fixing belt 101 may change between a rotating state and a stationary state. The deformation suppression member 131 may thus be made of a shape memory alloy which assumes a shape that conforms with the fixing belt 101 in the stationary state below a given temperature and assumes a shape as shown in FIG. 41 or FIG. 42 at or above the given temperature. With this, the deformation suppression member 131 may be made to conform with the fixing belt 101 more, in response to a temperature change of the fixing belt 101.

Figure 43:
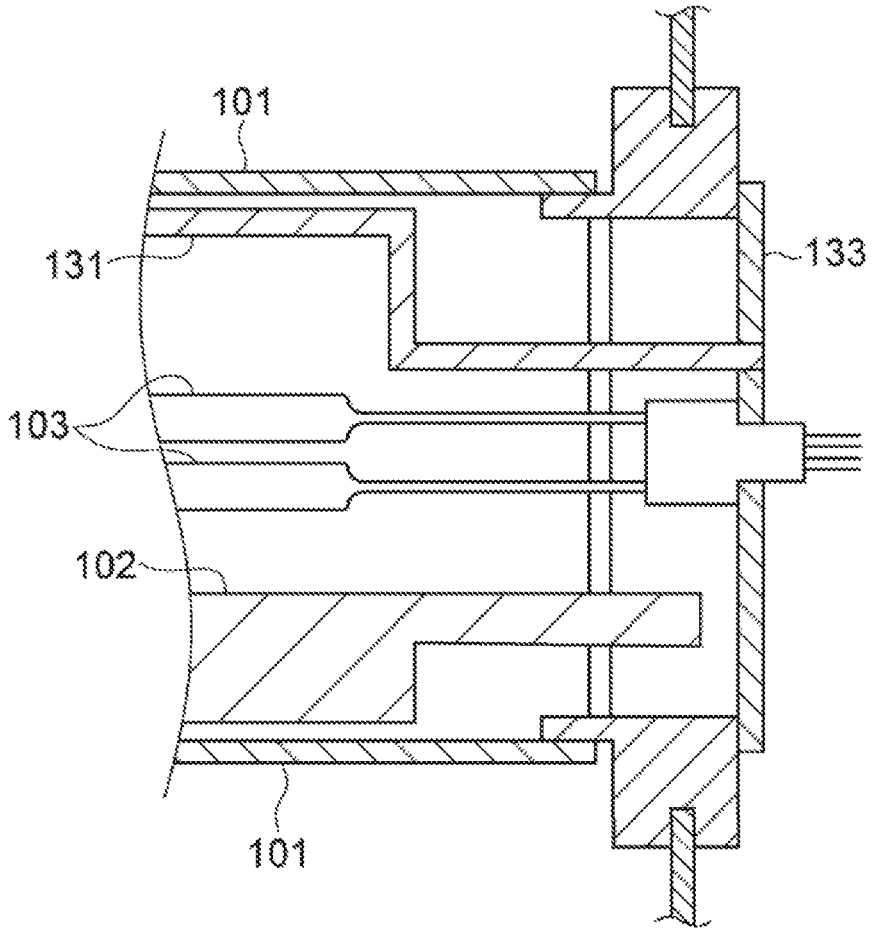
FIG. 43 is a schematic cross-sectional view of an example mounting structure of an example deformation suppression member.
Figure 44:
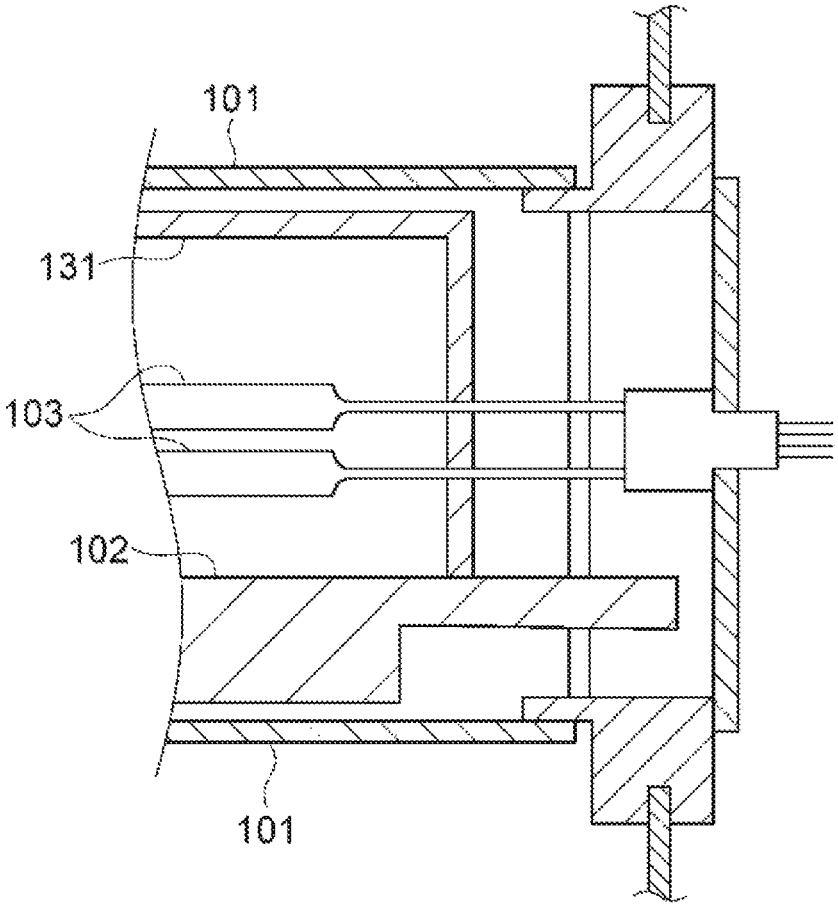
FIG. 44 is a schematic cross-sectional view showing an example mounting structure of an example deformation suppression member.

A mounting structure of the deformation suppression member 131 is not particularly limited. For example, as shown in FIG. 43, an end of the deformation suppression member 131 may be bent in a crank shape and mounted to a holder member 133 that holds an edge of the fixing belt 101 and an end of the heat source 103, or may be attached to a holder member (not shown) that holds an end of the pressure roller 54. As shown in FIG. 44, an end of the deformation suppression member 131 may be bent in an L-shape and mounted to the pusher member 102. When the deformation suppression member 131 is mounted to the pusher member 102, the deformation suppression member 131 may be integrated with the pusher member 102.

As shown in FIG. 38, when the fixing belt 101 is stationary, the fixing belt 101 is made to contact with the deformation suppression member 131. Then, upon normal rotation of the fixing belt 101, the fixing belt 101 deviates from the deformation suppression member 131, with the maximum temperature position MT contained within the detection area DA of the power supply shutoff member 104. This enables the power supply shutoff member 104 to detect the temperature of the fixing belt 101.

A case is assumed where the fixing belt 101 has been heated unusually without rotation, and the fixing belt 101 has contracted. In this case, as the fixing belt 101 is supported by the deformation suppression member 131 from an inner peripheral side, the maximum temperature position MT remains in the detection area DA. As the power supply shutoff member 104 can thereby continue detecting the temperature of the fixing belt 101, the supply of power to the heat source 103 can be shut off before the fixing belt 101 generates smokes or ignites.

Accordingly, in the example fixing device, as the at least one deformation suppression member 131 is mounted on an inner peripheral side of the fixing belt 101 and the deformation suppression member 131 is disposed in a position at which it does not come in contact with the fixing belt 101 during rotation of the fixing belt 101, obstruction to the rotation of the fixing belt 101 can be suppressed. As the deformation suppression member 131 is disposed in a position at which, upon contraction of the fixing belt 101, it supports the fixing belt 101 from an inner peripheral side of the fixing belt 101 to maintain the maximum temperature position MT in the detection area DA, the maximum temperature position MT of the fixing belt 101 can be kept in the detection area DA even if the fixing belt 101 has contracted. This enables the power supply shutoff member 104 to shutoff the supply of power to the heat source 103 before the fixing belt 101 smokes or ignites even when the fixing belt 101 has contracted.

In addition, the deformation suppression member 131 can be prevented from obstructing heating of the fixing belt 101 by the heat source 103 and placing the maximum temperature position MT outside the detection area DA.

In addition, as the deformation suppression member 131 is disposed in the detection area DA, the maximum temperature position MT of the fixing belt 101 can be maintained in the detection area DA more reliably when the fixing belt 101 has contracted.

In addition, as unusual heating of the fixing belt 101 frequently occurs in a stationary state where the fixing belt 101 is not rotating, when the deformation suppression member 131 contacts the fixing belt 101 in a stationary state of the fixing belt 101, contraction associated with unusual heating of the fixing belt 101 can be better suppressed and, even if the contraction has occurred, the maximum temperature position MT of the fixing belt 101 can be maintained in the detection area DA.

In addition, when the deformation suppression member 131 is formed in a rod shape, the blocking of the radiant heat from the heat source 103 by the deformation suppression member 131 can be suppressed when a halogen lamp is used as the heat source 103.

Further, when the deformation suppression member 131 is juxtaposed with the heat source 103 by extending on an inner peripheral side of the fixing belt 101 in a direction parallel with the rotation axis 101A, the contraction of the fixing belt 101 can be better suppressed.

Figure 45:
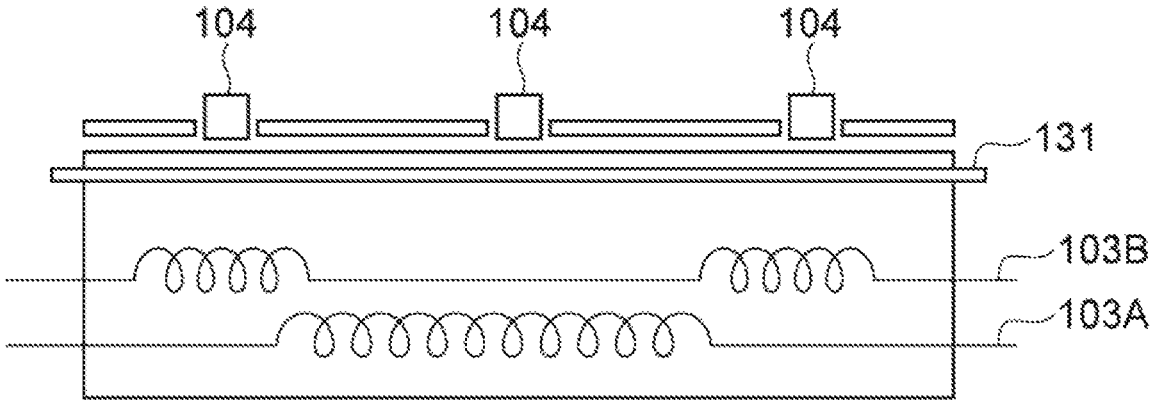
FIG. 45 is a schematic cross-sectional view of an example fixing device including a plurality of power supply shutoff members.

Other examples may be modified. For example, as shown in FIG. 45, where there are two halogen lamp heat sources 103 and light emission areas of the heat source 103A and heat source 103B are different from each other, the fixing belt 101 may have the maximum temperature position MT at a plurality of positions. In such case, a plurality of the power supply shutoff members 104 may be provided, in correspondence with the respective maximum temperature positions MT, so that all of the maximum temperature positions MT are included in the detection area DA.

Various features of the example image forming apparatuses described herein may be suitably interchanged or combined. For example, some features of the various examples described may be combined such that the fixing belt can be held between the power supply shutoff member and the deformation suppression member as the power supply shutoff member is pressed against the fixing belt by way of the elastic member. This enables a more reliable contact of the fixing belt with the power supply shutoff member and the contact state can be maintained.

The invention claimed is:

1. A fixing device to fix a toner image onto a recording medium formed with the toner image, the fixing device comprising:

a rotatable endless fixing belt being operable between a non-expanded state and a thermally expanded state;

a pusher member disposed on an inner peripheral side of the fixing belt, the pusher member extending in a direction parallel with a rotation axis of the fixing belt;

a pressure roller disposed on an outer peripheral side of the fixing belt, the pressure roller extending in the direction parallel with the rotation axis to form a fixing nip part by pressing the fixing belt against the pusher member;

a heat source disposed on the inner peripheral side of the fixing belt, the heat source extending in the direction parallel with the rotation axis to heat the fixing belt;

a power supply shutoff member disposed on the outer peripheral side of the fixing belt to shut off a supply of power to the heat source based on the thermally expanded state of the fixing belt; and a heat radiation plate disposed on the outer peripheral side of the fixing belt to cover part of the fixing belt, wherein the heat radiation plate is disposed in a position which is spaced from the fixing belt in the non-expanded state, and at which the heat radiation plate contacts the fixing belt when the fixing belt is in the thermally expanded state and to cause the power supply shutoff member to shut off the supply of power to the heat source.

2. The fixing device according to claim 1, wherein a minimum distance between the fixing belt in the non-expanded state and the heat radiation plate is approximately 5 mm or less.

3. The fixing device according to claim 1, wherein the heat radiation plate has a curved profile that conforms with the thermally expanded fixing belt.

4. The fixing device according to claim 1, wherein the heat radiation plate includes a metal.

5. The fixing device according to claim 4, wherein the metal material of the heat radiation plate includes at least one material selected from the group consisting of: Al, Cu, and SUS.

6. The fixing device according to claim 1, wherein the heat radiation plate includes a heat resistant resin.

7. The fixing device according to claim 6, wherein the resin material of the heat radiation plate includes at least one material selected from the group consisting of: PI, PAI, PTFE, PEEK, LCP, and PPS.

8. The fixing device according to claim 1, wherein the heat radiation plate and the power supply shutoff member are disposed linearly in the direction of the rotation axis of the fixing belt.

9. The fixing device according to claim 1, wherein the power supply shutoff member is disposed in an opening formed in the heat radiation plate.

10. The fixing device according to claim 1, wherein the power supply shutoff member is disposed in a vicinity of a position of the fixing belt which is farthest away from the fixing nip part.

11. The fixing device according to claim 1, wherein the fixing belt comprises a maximum temperature position where a maximum temperature is reachable when the fixing belt is heated by the heat source, and the power supply shutoff member is disposed in a vicinity of the maximum temperature position.

12. The fixing device according to claim 1, wherein the power supply shutoff member comprises a detection surface to detect the contact with the fixing belt when the fixing belt is in the thermally expanded state, and a minimum distance between the fixing belt in the non-expanded state and the detection surface is shorter than a minimum distance between the fixing belt in the non-expanded state and the heat radiation plate.

13. The fixing device according to claim 12, wherein the difference between the minimum distance between the fixing belt and the detection surface and the minimum distance between the fixing belt and the heat radiation plate is approximately 3 mm or less.

14. The fixing device according to claim 1, wherein the thermal capacity of the heat radiation plate per unit area is larger than the thermal capacity of the fixing belt per unit area.

15. The fixing device according to claim 1, wherein the heat radiation plate extends along approximately 10% to 70% of the peripheral length of the fixing belt.

16. The fixing device according to claim 1, comprising a plurality of heat radiation plates including the heat radiation plate, wherein the plurality of heat radiation plates are arranged along a periphery of the fixing belt.

17. The fixing device according to claim 1, wherein a surface of the heat radiation plate facing the fixing belt is provided with an adhesive.

18. The fixing device according to claim 1, wherein the heat source includes a halogen lamp.

19. The fixing device according to claim 1, wherein a surface of the heat radiation plate facing the fixing belt includes a reflection surface to reflect radiant heat from the fixing belt back to the fixing belt.

20. An image forming apparatus comprising:

a rotatable endless fixing belt being operable between a non-expanded state and a thermally expanded state;

a heat source disposed adjacent the fixing belt, to heat the fixing belt;

a heat radiation plate located adjacent the fixing belt to contact the fixing belt when the fixing belt is in the thermally expanded state as a result of being heated by the heat source; and a power supply shutoff member adjacent the fixing belt to shut off the supply of power to the heat source based on the thermally expanded state of the fixing belt when the heat radiation plate contacts the fixing belt in the thermally expanded state.

* * * * *